US012465972B2

(12) United States Patent
Evans et al.

(10) Patent No.: US 12,465,972 B2
(45) Date of Patent: Nov. 11, 2025

(54) COMPUTER IMPLEMENTED METHOD FOR ADJUSTING A FASTENER SETTING TOOL

(71) Applicant: Atlas Copco IAS UK Limited, Wales (GB)

(72) Inventors: Mike Evans, Wrexham Clwyd (GB); Peter J. Elliot, Novi, MI (US); A. Paul Savage, Warrington (GB); Kyle Weirauch, Swartz Creek, MI (US); Wesley Stocker, Highland, MI (US)

(73) Assignee: Atlas Copco IAS UK Limited, Flintshire (GB)

( * ) Notice: Subject to any disclaimer, the term of this patent is extended or adjusted under 35 U.S.C. 154(b) by 5 days.

(21) Appl. No.: 18/262,251

(22) PCT Filed: Jan. 5, 2022

(86) PCT No.: PCT/GB2022/050005
§ 371 (c)(1),
(2) Date: Jul. 20, 2023

(87) PCT Pub. No.: WO2022/157481
PCT Pub. Date: Jul. 28, 2022

(65) Prior Publication Data

US 2024/0075519 A1 Mar. 7, 2024

(30) Foreign Application Priority Data

Jan. 20, 2021 (GB) ..... 2100780

(51) Int. Cl.
*B21J 15/28* (2006.01)
*B21J 15/26* (2006.01)
*B21J 15/02* (2006.01)

(52) U.S. Cl.
CPC ..... *B21J 15/285* (2013.01); *B21J 15/26* (2013.01); *B21J 15/025* (2013.01)

(58) Field of Classification Search
CPC ..... B21J 15/28; B21J 15/285
See application file for complete search history.

(56) References Cited

U.S. PATENT DOCUMENTS 4,959,797 A 9/1990 McIntosh
5,154,242 A * 10/1992 Soshin ..... B25B 23/147 173/180

(Continued)

FOREIGN PATENT DOCUMENTS

EP 3181260 B1 9/2019
JP 2004306115 A 11/2004
TW I626097 B 6/2018

OTHER PUBLICATIONS

International Preliminary Report on Patentability and Written Opinion for Application No. PCT/GB2022/050005 dated Jul. 20, 2023 (8 pages).

(Continued)

*Primary Examiner* — Gloria R Weeks
(74) *Attorney, Agent, or Firm* — Michael Best & Friedrich LLP

(57) ABSTRACT

A computer implemented method for adjusting a fastener setting tool, the method comprising: measuring a first parameter associated with a first characteristic of the fastener setting tool; comparing the first parameter to a predetermined parameter, wherein the difference between the first parameter and the predetermined parameter represents a condition of the fastener setting tool; calculating an adjustment based on the comparison, wherein the adjustment is to the first characteristic of the fastener setting tool and/or to a second characteristic of the fastener setting tool, the adjustment configured to compensate for the condition of the tool; and applying the adjustment to the fastener setting tool.

16 Claims, 16 Drawing Sheets

(56) References Cited

U.S. PATENT DOCUMENTS

| | | | | |
|---|---|---|---|---|
| 5,655,289 | A * | 8/1997 | Wille | B21J 15/26 29/703 |
| 6,502,008 | B2 * | 12/2002 | Maurer | B21J 15/28 700/174 |
| 6,668,212 | B2 * | 12/2003 | Colangelo, III | B25B 23/1453 700/275 |
| 9,015,920 | B2 * | 4/2015 | Mauer | B21J 15/025 29/432.1 |
| 9,079,240 | B2 * | 7/2015 | Schiffler | B21J 15/105 |
| 10,071,414 | B2 * | 9/2018 | Scharfenberg | B21J 15/28 |
| 10,464,122 | B2 * | 11/2019 | Blacket | B21J 15/043 |
| 10,850,377 | B2 * | 12/2020 | Steurer | B25F 5/00 |
| 2002/0166221 | A1 * | 11/2002 | Clew | B21J 15/025 29/714 |
| 2015/0041164 | A1 * | 2/2015 | Sergyeyenko | B25B 23/147 173/176 |
| 2015/0150556 | A1 * | 6/2015 | McCuen | A61B 17/068 173/1 |

OTHER PUBLICATIONS

International Preliminary Report on Patentability and Written Opinion for Application No. PCT/GB2022/050005 dated Apr. 12, 2022 (11 pages).

Great Britain Search Report for Application No. GB2100780.2 dated Oct. 20, 2021 (2 pages).

* cited by examiner

COMPUTER IMPLEMENTED METHOD FOR ADJUSTING A FASTENER SETTING TOOL

CROSS REFERENCE TO RELATED APPLICATIONS

This application is a U.S. national phase application of International Application No. PCT/GB2022/050005, filed Jan. 5, 2022, which claims priority to Great Britain Application No. GB 2100780.2, filed Jan. 20, 2021, the entire contents of both of which are herein incorporated by reference.

TECHNICAL FIELD

This invention relates to a computer implemented method for adjusting a fastener setting tool. In particular, it relates to a method for adjusting a fastener setting tool to compensate for a condition of the tool.

BACKGROUND

Various fastener setting tools and methods are known for inserting fasteners into a workpiece (e.g. sheet material). For example, self-piercing rivet tools may be used for inserting fasteners into a workpiece without the workpiece being pre-drilled or punched. A known self-piercing rivet tool comprises a punch, which may be actuated to drive a rivet towards and into a workpiece. The workpiece is typically supported on a die, towards which the punch is driven. By driving the punch towards the die, a rivet setting force or rivet setting energy is provided to the rivet. When the rivet comes into contact with the workpiece, the rivet setting force or energy aids the insertion of the rivet into the workpiece.

A rivet inserted into a workpiece may be referred to as a joint or riveted joint, as it can join workpieces together. Variables such as the type of rivet, type of die and amount of rivet setting force, affect the characteristics of a joint. The characteristics of the joint can affect the performance of a joint, and there are typically one or more optimal combinations of variables which will provide an optimal performance for a specific joint. The variables are typically selected depending on the materials being joined.

For an optimal joint, the rivet is inserted such that the rivet head lies at a specific height compared to the top surface of the workpiece, where the specific height is typically zero (i.e. the rivet head is flush with the top surface).

In a sub-optimal joint, the rivet may not be sufficiently inserted into the workpiece, and the rivet head will hence stand proud of the top surface of the workpiece. That is, the rivet head will lie at a height above the surface of the workpiece. Such a sub-optimal joint may be referred to as proud or overflush. Overflush joints can occur when the rivet setting energy is too low for the combination of rivet, die and workpieces used.

In another sub-optimal joint, the rivet may be inserted too far into the workpiece, and the rivet head will hence be driven too deeply into the workpiece. That is, the rivet head will lie at a height below the surface of the workpiece. Such a sub-optimal joint may be referred to as indented or underflush. Underflush joints can occur when the rivet setting energy is too high for the combination of rivet, die and workpieces used.

Both underflush and overflush joints are typically associated with a loss of performance of the fastening process, and it may therefore be desirable to provide accurate control of the rivet setting force used during insertion of the rivet.

A known self-piercing rivet tool uses an electrically powered motor to drive the punch. Such rivet tools typically comprise one or more flywheels or other inertial masses with the tool assembly which are maintained at a substantially constant angular velocity by an electric motor. The inertia of a tool assembly allows energy to be stored in the tool assembly prior to rivet insertion. The rotational motion of the tool assembly may be converted into reciprocating linear movement. By transferring a portion of the stored inertial energy to the punch in the form of linear movement, the punch may be driven towards or away from the die, depending on which direction the tool assembly is spinning. A tool of this type may be referred to as an inertial rivet setter.

Using an inertial rivet setter, the amount of energy available to provide to a rivet has a contribution from the inertia of the flywheel, the linear momentum of the tool and the torque provided by the motor. The amount of energy available to provide to a rivet may be reduced by frictional losses within the tool. Frictional losses may vary depending on the condition of the tool. Conditions may include, for example, temperature, age, fastener characteristics, workpiece characteristics, previous usage of tool, lubrication characteristics (e.g. amount of lubrication, temperature of lubrication), and others.

A tool may be in a 'cold' state. A tool may be cold when it is at a temperature below a desired operating temperature. A tool may be cold when an insertion cycle has not been performed recently. A tool may also be in a cold state when there is increased internal friction, for example due to lubrication being at a sub-optimal temperature (e.g. cold) or other factors such as the tool being used with new, worn or damaged parts/components.

Alternatively, a tool may be in a 'warm' state. A tool may be warm when it is at a desired operating temperature. A tool may be warm when sufficient insertion cycles have been performed recently, for example within the last 15 minutes. A tool may also be in a warm state when there is reduced internal friction, for example due to lubrication being at an optimal temperature (e.g. warm), other factors such as the tool being used with parts/components which are not new, worn or damaged.

Alternatively, a tool may be 'warming'. A warming tool may be between 'cold' and 'warm' states.

Cold and/or warming tools may experience greater internal friction compared to warm tools. The increased internal friction may be due to viscosity changes in lubrication and/or the movement and location of lubrication within in the tool, as well as changes in internal component condition. As such, it is beneficial to operate a warm tool as less driving force is required compared to a cold or warming tool. However, it is necessary to use a cold or warming tool, for example as a tool will be cold when it is initially used. In such cases, it may be beneficial to compensate for frictional losses.

SUMMARY

According to a first example described herein there is provided a computer implemented method for adjusting a fastener setting tool, the method comprising: measuring a first parameter associated with a first characteristic of the fastener setting tool; comparing the first parameter to a predetermined parameter, wherein the difference between the first parameter and the predetermined parameter represents a condition of the fastener setting tool; calculating an adjustment based on the comparison, wherein the adjustment is to the first characteristic of the fastener setting tool and/or to a second characteristic of the fastener setting tool, the adjustment configured to compensate for the condition of the tool; and applying said adjustment to the fastener setting tool.

The performance of a fastener setting tool may vary depending on the condition of the tool, for example if the tool is cold, warming or warm. By using this method, the varying performance of the tool may be compensated for. In particular, losses can be indirectly determined by measuring the first parameter and comparing it to the predetermined parameter. Calculating and applying an adjustment thereon therefore provides a compensation method. Such a compensation method may beneficially improve the performance of the tool.

The predetermined parameter may be a theoretical value, an empirical value measured in a previous insertion cycle of a fastener setting tool, an empirical value measured earlier in the same insertion cycle, or a combination thereof. The predetermined parameter may be an expected parameter. The predetermined parameter may be associated with the first characteristic. The first parameter may be measured at a time when the first characteristic is substantially constant.

The condition may represent one or more of: temperature, age, use history and lubrication of the fastener setting tool or components thereof.

The temperature may comprise a current temperature compared to an optimum operating temperature. Age may comprise an amount of time since manufacture or an amount of time since a maintenance event e.g. a calibration or service. Use history may comprise previous use of the tool, for example a number of previous fastener insertions performed by the tool and/or a time since the most recent insertion was performed by the tool. Lubrication condition may include a temperature of the lubrication, a chemical composition of lubrication, an age of lubrication, an amount of lubrication, a location or distribution of lubrication. Components of the fastener setting tool may comprise component parts of the tool itself and/or fasteners and workpieces to be fastened by the tool.

The first characteristic may comprise one of a torque of a motor of the fastener setting tool or a velocity of a setting portion of the fastener setting tool. The torque of the motor may be measured and/or represented as a motor speed or an electrical stimulation provided to the motor. The setting portion may comprise for example a punch, fastener, setter of the tool. A velocity of a fastener in or on the setting portion of the tool may be measured rather than the velocity of the setting portion itself.

The second characteristic may comprise the other of a torque of a motor of the fastener setting tool or a velocity of a setting portion of the fastener setting tool. The torque of the motor may be measured and/or represented as a motor speed or an electrical stimulation provided to the motor. The setting portion may comprise for example a punch, fastener, setter of the tool. A velocity of a fastener in or on the setting portion of the tool may be measured rather than the velocity of the setting portion itself.

The measurement of the first parameter may be performed when the second characteristic is at a predetermined second parameter. The second parameter is associated with the second characteristic.

If the first characteristic comprises a torque of the motor, the measurement of the first parameter may be performed when the velocity of the setting portion is at a predetermined velocity. Alternatively, if the first characteristic comprises a velocity of the setting portion, the measurement of the first parameter may be performed when the torque of the motor is at a predetermined motor torque.

The method may further comprise causing a fastener to be inserted with the adjusted fastener setting tool. The fastener setting tool may be referred to as an adjusted fastener setting tool after the adjustment has been applied.

The measuring may be performed during a first fastener insertion cycle and the adjustment may be applied in the first fastener insertion cycle. By measuring, calculating an adjustment, and applying said adjustment in a single insertion cycle, the condition of the tool can be compensated for prior to insertion of a fastener.

The measuring may be performed during a first fastener insertion cycle and the adjustment is applied in a second fastener insertion cycle. The adjustment may be applied in said second fastener insertion cycle while no measurements of the first parameter are performed in the second fastener insertion cycle. The adjustment may be applied in additional fastener insertion cycles, for example the adjustment may be applied for ten or twenty cycles.

The method may further comprise determining the condition of the fastener setting tool. For example, the condition may be estimated based on the difference between first parameter and the predetermined parameter.

The adjustment may be only applied if the condition satisfies a predetermined condition. The adjustment may be only applied if the condition is sub-optimal. For example, an adjustment may be applied to multiple insertion cycles while a tool condition is cold or warming, and the adjustment may be halted when the tool condition is considered warm.

The comparison may be further based on one or more stored parameters, wherein the one or more stored parameters correspond to parameters associated with the fastener setting tool measured prior to the measurement of the first parameter. The stored parameters may be stored in a storage device of the fastener setting tool The method may be performed iteratively to form a feedback loop.

A plurality of measurements of the first parameter may be taken. The plurality of measurements may be averaged to provide a single measurement. The averaging of measurements may be performed with measurements occurring in a single revolution of the motor. The averaging may be weighted, for example based on a position of the motor within its revolution as the measurement is taken, and/or based on a confidence value. A confidence value may be based on a comparison between the measured one or more measurements of the first parameter and previous measurements of the first parameter and/or theoretical values associated with the first parameter. Each measurement of the first plurality of measurements may be performed when the motor of the fastener setting tool is in a predetermined orientation.

The plurality of measurements may be taken when the first characteristic and/or second characteristic is substantially constant. For example, when the first characteristic comprises a velocity of the tool, measurements may be taken when the velocity is substantially constant, for example when the setter is advancing at a constant velocity. For example, when the first characteristic comprises a motor torque, measurements may be taken when the torque is substantially constant. It will be appreciated that the term "substantially constant" is intended to allow for small oscillations and/or noise and/or drifts associated with the first characteristic and/or second characteristic and that such oscillations do not render the characteristic 'non-constant'.

The first parameters associated with the plurality of measurements may be averaged. The averaging may be dependent on a revolution time of a motor of the tool.

The adjustment may comprise an instruction to increase the electrical stimulation provided to a motor of the fastener setting tool. Applying the adjustment may comprise providing said instruction to a data processing system of the fastener setting tool.

The method may further comprise providing a warning based upon the condition of the fastener setting tool. The warning may comprise an indication of a request for inspection and/or repair of the tool. The warning may be provided in response to the condition surpassing a threshold. The warning may be provided as a result of the condition of the tool surpassing a threshold despite other characteristics of the tool being within an allowable range, for example if the tool condition is sub-optimal despite the tool operating at a theoretically optimal operating temperature.

According to a second example described herein there is provided a fastener setting tool comprising: a sensor operable to measure a first parameter associated with a first characteristic of the fastener setting tool; a data processing system comprising means for carrying out the steps of: comparing the first parameter to a predetermined parameter, wherein the difference between the first parameter and the predetermined parameter represents a condition of the fastener setting tool; calculating an adjustment based on the comparison, wherein the adjustment is to the first characteristic of the fastener setting tool and/or to a second characteristic of the fastener setting tool, the adjustment configured to compensate for the condition of the tool; and providing an instruction to the fastener setting tool, wherein the instruction comprises the adjustment; and means to apply said adjustment to the tool.

According to a third example described herein there is provided a computer-readable medium comprising instructions which, when executed by a data processing system of a fastener setting tool, causes the tool to carry out the steps of the first example.

Also described herein is a computer implemented method for adjusting a fastener setting tool, the method comprising: measuring a first parameter associated with a first characteristic of the fastener setting tool in a first insertion cycle of the fastener setting tool; comparing the first parameter to a predetermined parameter; calculating an adjustment based on the comparison; applying said adjustment to the fastener setting tool and causing a fastener to be inserted with the adjusted fastener setting tool in the first insertion cycle.

DRAWINGS

The invention will now be described purely by way of example with reference to the following drawings in which.

DESCRIPTION

The invention is described in reference to a fastener setting tool. We describe in particular an example fastener setting tool used in self-piercing rivet setting machines of the type that set self-piercing rivets. For example, self-piercing rivet setting tools may be used on workpieces and plates of various thicknesses, for manufacturing vehicle bodies such as automobile frames and/or panels. However, it will be understood that the present invention is not limited thereto and the arrangements described herein may be equally applicable to other fastener setting tools and fastener setting tools used for manufacture of other items. Additionally, it will be understood that, while particularly suited to rivets, the present invention may be equally applicable to other fasteners, for example screws, nails and studs.

Figure 1:
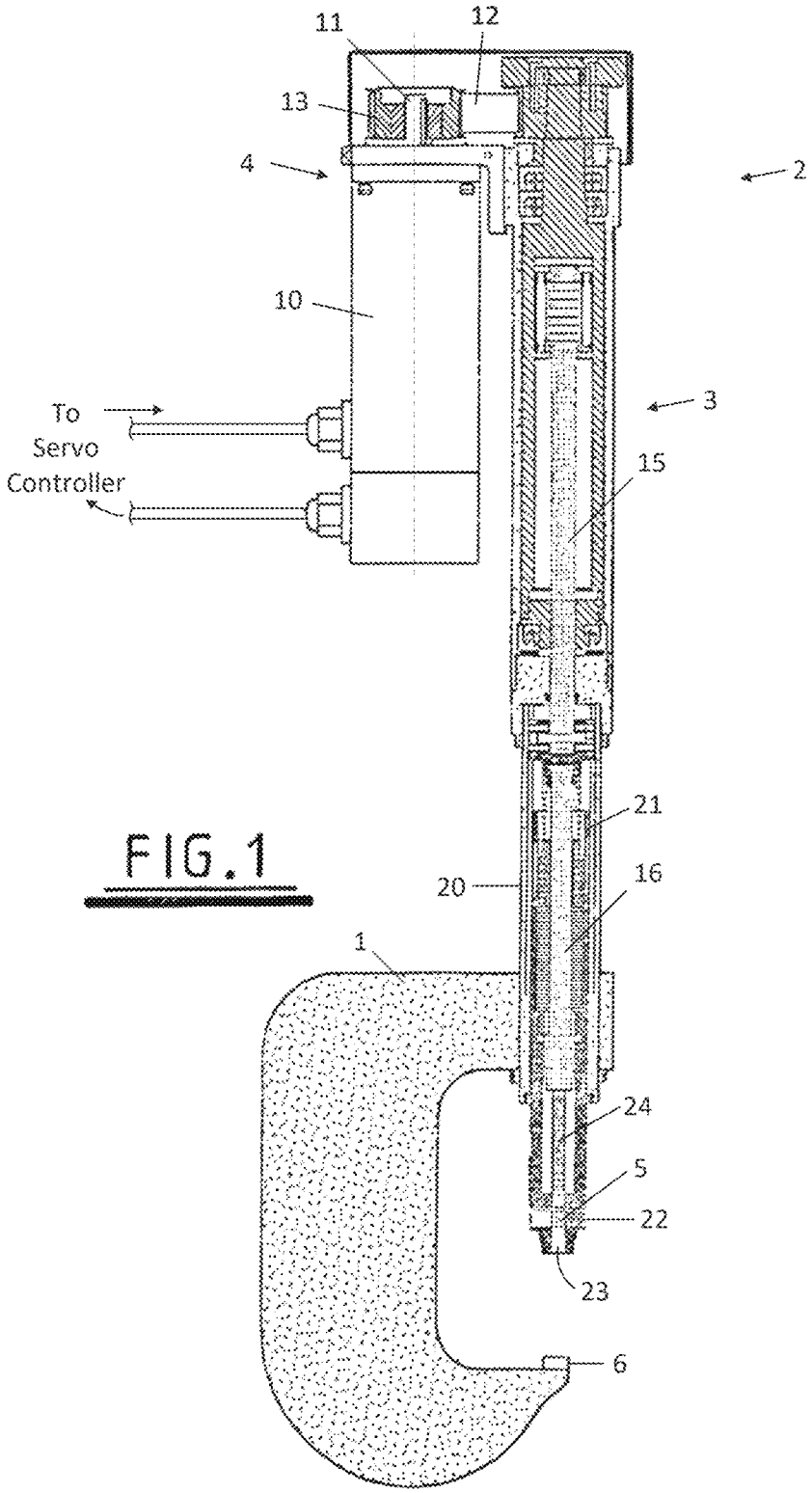
FIG. 1 is a longitudinal schematic cross-sectional view of an example fastener setting tool.

An example fastener setting tool 2 is illustrated schematically in FIG. 1. The fastener setting tool may be referred to herein simply as a tool. The tool 2 is mounted on a conventional C-frame 1 which holds a die 6 which reacts against a force generated by the tool during rivet insertion. Fastener setting tools are often incorporated into robotic systems so that they can travel and be positioned where required within a working area, according to many different orientations. To achieve this, the tool 2 is mounted on a C-frame which is, in turn, mounted on a robotic system.

The tool 2 is used to insert rivets 5 into a workpiece (not shown) that is placed between a nose section 22 of the tool 2 and a die 6 installed on the C-frame 1 on a side of the C-frame opposing the tool 2. In this description, directional language may be used relating to the workpiece, e.g. moving towards or away from the workpiece. This directional language should be interpreted as relating to the workpiece in position in normal operation i.e. placed between the nose section 22 of the tool 2 and the die 6.

The tool 2 comprises a drive assembly 4 operable to drive a linear actuator assembly 3. The drive assembly 4 comprises an electric motor 10. An output shaft 11 of the motor 10 is typically connected in parallel to the linear actuator assembly 3, for example via an endless toothed belt 12 and drive pulleys (not shown). The linear actuator assembly 3 converts the rotational motion of the motor output shaft 11 into a reciprocating linear movement of an elongate output shaft 15 that is connected to a plunger 16 of the tool 2.

The tool 2 is connected to a control system (not shown) incorporating a data processing sub-system. The data processing system is operable to provide instructions to components of the tool. For example, the data processing system may be operable to provide instructions to change the speed of the electric motor 10. The data processing system may comprise a servo-controller. The data processing system may further comprise memory operable to store a parameter associated with one or more portions of the tool 2. For example, the data processing system may be used to store historic data regarding the speed of the electric motor 10 and/or a condition of the tool 2.

The tool 2 comprises a housing 20, in which a clamping tube 21 is slidably disposed. The nose section 22 is provided at the end of the clamping tube 21. The nose section 22 is arranged coaxially with the clamping tube 21 and has a rivet delivery passage 23 through which a rivet 5 may be guided to the workpiece. The rivet 5 is moved through the delivery passage 23 by a punch 24 that is carried by the plunger 16. The punch 24 and plunger 16 are arranged for reciprocal axial movement within the clamping tube 21 and the delivery passage 23 and are driven by the output shaft 15 of the linear actuator assembly 3. The output shaft 15, plunger 16 and punch 24 together may be referred to as a setter.

Linear movement of the output shaft 15 forces the plunger 16 and punch 24 to move relative to the housing 20 of the tool 2 and towards the workpiece. This movement continues until the end face of the nose section 22 contacts the workpiece whereupon the clamping tube 21 is prevented from further advancement. Continued extension of the output shaft 15 then moves the setter relative to the clamping tube 21 and nose section 22. The rivet 5 to be inserted is driven through the delivery passage 23 and is brought into contact with the workpiece. Further advancement of the setter drives the rivet 5 into the workpiece.

The insertion of a single fastener may be referred to as an insertion cycle. During an insertion cycle, the tool 2 begins in an initial position, performs actions to move a rivet 5 through the rivet delivery passage 23 towards the workpiece and drive the rivet 5 into the workpiece before moving to a final position. That is, an insertion cycle as described herein includes all movements of the tool 2 required to set a rivet 5, and the rivet 5 is only physically driven into the workpiece during a portion of an insertion cycle.

The rivet 5 is advanced towards the workpiece at a rivet velocity. The rivet velocity may be different at various times and/or positions within the insertion cycle. The rivet velocity is set by the velocity of the setter. As such, the rivet velocity during its advancement towards the workpiece may be referred to as a setter velocity. The setter velocity may be considered the velocity of a setting portion (i.e. the setter) of the tool 2.

The tool 2 comprises a means to measure a velocity such that the setter velocity and/or rivet velocity may be measured during an insertion cycle. For example, the tool 2 may comprise at least one sensor capable of measuring velocity such as a velocity encoder (not shown). The velocity may be measured directly or indirectly. That is, the tool 2 may comprise a means to measure a displacement of the setter and/or rivet (displacement being velocity multiplied by time). Rivet and/or setter acceleration may also be calculated from measured velocity, time, and/or displacement data. The measured data may be provided to the data processing system.

The rivet may be accelerated such that it attains a required setting velocity prior to contacting the workpiece. The required setting velocity may be chosen to provide an optimum rivet insertion force for a given insertion cycle. The required setting velocity is chosen to optimise one or more characteristics of the insertion cycle. For example, the required setting velocity may be chosen to provide an optimum rivet insertion force for a given insertion cycle. The required setting velocity may be chosen in dependence on a characteristic of a fastener (e.g. material, diameter, length) and/or a characteristic of the workpiece (e.g. thickness, material).

After insertion, the rivet velocity is effectively zero relative to the workpiece. Once the rivet has been inserted, the direction of rotation of the motor output shaft is reversed so as to retract the setter ready for the next rivet to be inserted.

The servo-control system comprises a servo-controller for the motor operating under the control of a suitable computer program. The program operates to issue instructions for the servo-controller to control the torque of the motor. For example, the instructions may invoke a change in position or velocity over time based on a position profile or velocity profile. By controlling the motion of the motor, the rivet velocity, and hence position, may also be controlled. Generally, a higher torque over a given time will accelerate a rivet to, or maintain a rivet at, a higher velocity compared to a lower torque.

Figure 2A:
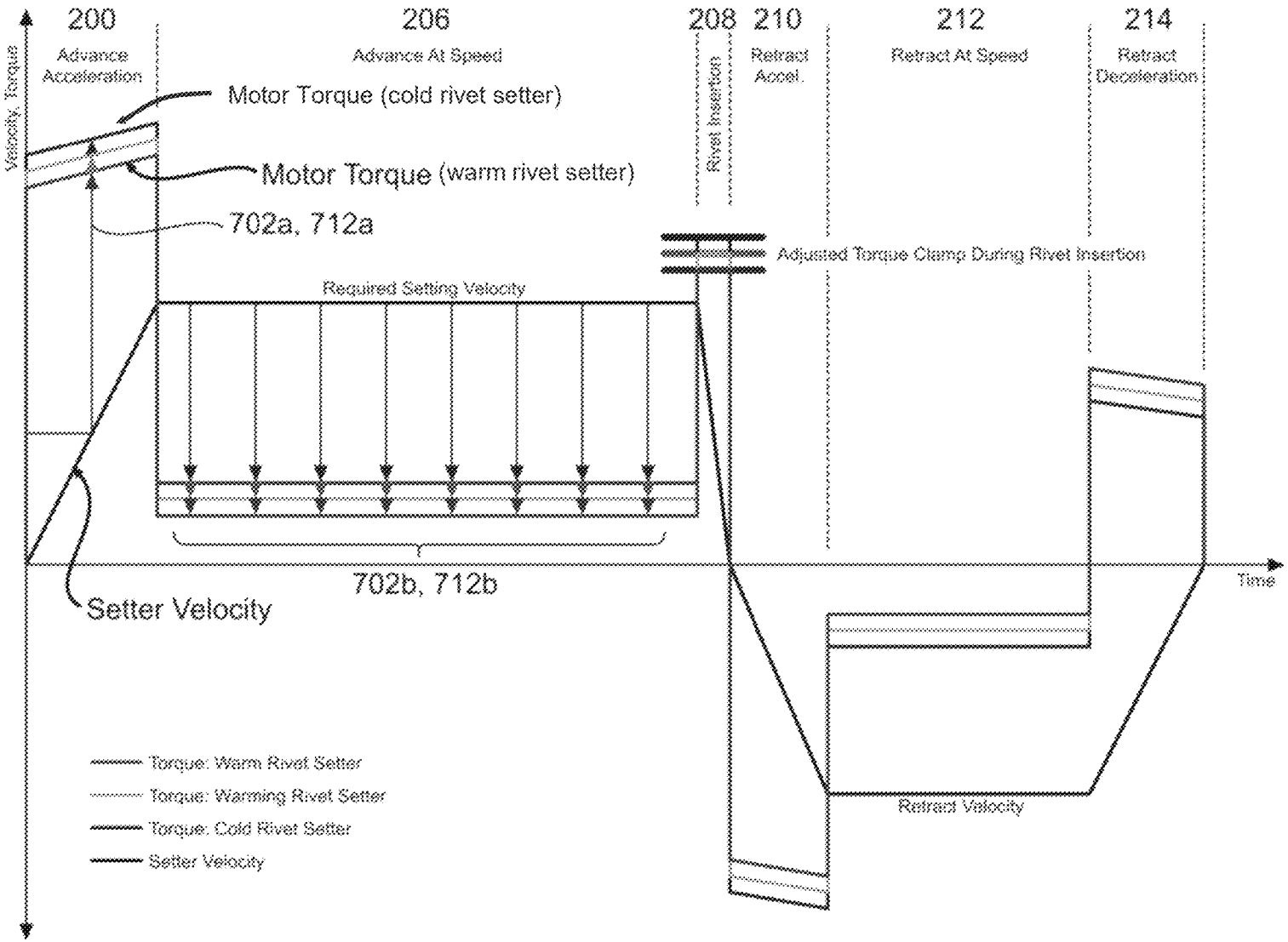
FIG. 2A illustrates a simplified relationship between motor torque and setter velocity in a first type of insertion cycle.

FIG. 2A illustrates a simplified relationship between motor torque and setter velocity in a first type of insertion cycle at a variety of setter conditions (cold, warming and warm). The insertion cycle may be described in terms of a number of phases: advance acceleration 200, advance at speed 206, rivet insertion 208, retract acceleration 210, retract at speed 212, and retract deceleration 214.

Advance acceleration 200. The setter begins in an initial position. The initial position may be a position where the tool is retracted to the furthest possible distance away from the workpiece (e.g. the limit of movement allowed by the tool), which is referred to as a home position. The initial position may be between the home position and the workpiece, but should be far enough away from the workpiece such that the required setting velocity is attainable.

The motor 10 is instructed to accelerate the tool 2 toward the workpiece at a given rate to the required setting velocity. While accelerating, the amount of motor torque required to maintain the acceleration will depend on the condition of the tool 2, for example whether the tool 2 is cold, warming or warm. As can be seen in FIG. 2A, a cold tool may require a higher acceleration torque to provide a given acceleration (that is, to accelerate the setter to the required setting velocity in a given time) compared to a warming or warm tool.

Advance at speed 206. Once the required setting velocity is attained, the motor torque is reduced to a value capable of maintaining the setter at the required setting velocity. The torque during advance at speed 206 may be referred to as a coast torque. The coast torque is be provided to overcome losses due to resistance (e.g. friction) present in the tool. The required value of coast torque required may depend on the condition of the tool, for example whether the tool is cold, warming, or warm. As can be seen in FIG. 2A, a cold tool requires a higher coast torque to maintain the required setting velocity compared to a warming or warm tool.

Before advance acceleration 200 is initiated, a rivet 5 is loaded under the punch 24 of the setter and is hence accelerated to the required setting velocity with the nose piece 22. Once the nose piece 22 makes contact with the workpiece, the rivet 5 continues to be driven by the punch 24 and travels through the nose piece 22 until the rivet 5 reaches the workpiece.

Rivet insertion 208. The rivet contacts the workpiece while travelling at the required setting velocity, at which point it will rapidly decelerate and begin to be inserted into the workpiece. The rivet deceleration causes the setter to decelerate. The motor torque is rapidly increased to provide additional torque in an attempt to maintain the setting velocity as the rivet is being inserted. The additional torque is limited to a predetermined maximum value which may be referred to as a torque limit. The combination of setter deceleration and additional torque contribute to the insertion force provided to the rivet, which causes the rivet to be inserted into the workpiece. The torque limit may be chosen in dependence on the desired insertion force. For example, a larger torque limit may be chosen to provide a greater insertion force, or in response to an increase in the setting velocity.

In the example insertion cycle depicted in FIG. 2A, the torque limit is adjusted based on the condition of the tool, for example whether the tool is cold, warming, or warm. In this example, the torque limit is increased for a cold tool compared to a warming or warm tool. During rivet insertion 208, the rivet will continue to be inserted into the workpiece until it decelerates to substantially zero velocity. At this stage, the setter will correspondingly have decelerated to substantially zero velocity.

Retract acceleration 210. The direction of motor torque is reversed to accelerate the setter in the opposite direction i.e. retract it away from the workpiece. The setter is accelerated to a retract velocity. Similar to advance acceleration 200, the motor torque required to maintain the acceleration may depend on the condition of the tool, for example whether the tool is cold, warming, or warm.

Retract at speed 212. Once the retract velocity is attained, the motor torque may be reduced to a value capable of maintaining the setter at the retract velocity. Similar to advance at speed 206, the value of torque required to maintain the retract velocity may depend on the condition of the tool, for example whether the tool is cold, warming, or warm.

Retract deceleration 214. After retract at speed 212, the tool is decelerated to a stop (zero velocity). Deceleration is provided by inverting the direction of the motor torque. The time and/or tool position at which the retract deceleration 214 phase is initiated is selected based on the retract velocity, deceleration rate, and the desired final position. The final position is a point in space between, and including, the home position, and a minimum distance from the workpiece from which a subsequent insertion cycle may begin. The final position may be referred to as the end position.

Similar to advance acceleration 200 and retract acceleration 210, the motor torque required to attain the required rate of deceleration may depend on the condition of the tool, for example whether the tool is cold, warming, or warm.

Figure 2B:
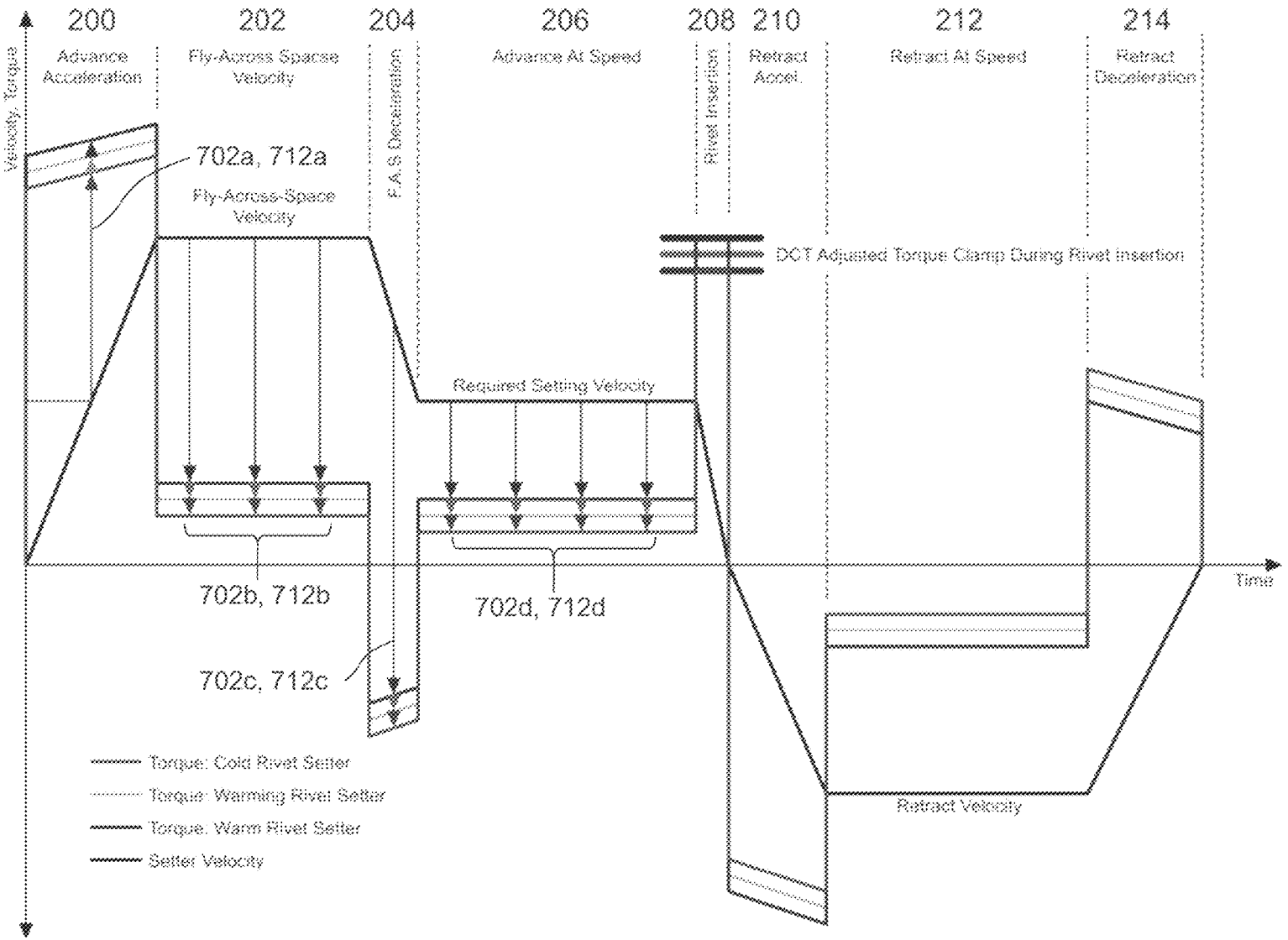
FIG. 2B illustrates a simplified relationship between motor torque and setter velocity in a second type of insertion cycle.

FIG. 2B illustrates a simplified relationship between motor torque and setter velocity in a second type of insertion cycle at a variety of setter conditions (cold, warming and warm). The insertion cycle may be described in terms of a number of phases: advance acceleration 200, fly-across space (FAS) 202, FAS deceleration 204, advance at speed 206, rivet insertion 208, retract acceleration 210, retract at speed 212, and retract deceleration 214. The second type of insertion cycle may be referred to as FAS type. A FAS type insertion cycle is used to reduce cycle time. FAS type insertion cycles are of particular use for tools and insertion cycles where the selected required setting velocity is a fraction of the maximum velocity attainable by the tool. For example, if a required setting velocity is 100 mm/s, but a tool may achieve 400 mm/s movement speeds, the FAS type insertion cycle may be used to reduce cycle time.

The phases of advance at speed 206, rivet insertion 208, retract acceleration 210, retract at speed 212, and retract deceleration 214 of the FAS type cycle depicted in FIG. 2B are comparable to the correspondingly named and numbered phases in FIG. 2A. The altered phase of advance acceleration 200 and the additional phases of fly-across space (FAS) 202 and FAS deceleration 204 are described below.

Advance acceleration 200. The setter begins in an initial position as described above. The motor 10 is instructed to accelerate the tool 2 toward the workpiece at a given rate a FAS velocity.

FAS 202. Once the FAS velocity is attained, the motor torque is reduced to a value capable of maintaining the setter at the FAS velocity. The FAS velocity is faster than the required setting velocity. The torque required to maintain the FAS velocity during the FAS 202 phase may be referred to as a FAS torque. The FAS phase may also be referred to as an advance at high speed phase. As with the above discussion regarding motor torque and tool condition, the FAS torque required may depend on tool condition.

FAS deceleration 204. A change in velocity is initiated at a position between the initial position and the workpiece, which causes the tool to decelerate to the required setting velocity. The torque required to decelerate the tool in the FAS deceleration 204 phase may be referred to as FAS deceleration torque. As with the above discussion regarding motor torque and tool condition, the FAS deceleration torque required may depend on tool condition.

Other types of insertion cycle are also possible, and the compensation methods described herein are not limited to the two illustrated insertion cycle types. For example, rather than a FAS phase 202 wherein the FAS velocity is greater than the required setting velocity, an insertion cycle may have a phase wherein the setter velocity is less than the required setting velocity.

In FIGS. 2A and 2B, the magnitude of motor torques and setter velocities are not shown to scale. In particular, motor torque during acceleration phases (advance acceleration 200, FAS deceleration 204, retract acceleration 210, retract deceleration 214) is illustrated as having a gradient. This is for illustrative purposes only, and in use the gradient of motor torque in use is small (i.e. the motor torque is substantially constant during acceleration phases).

With reference to FIGS. 2A and 2B, it can be seen that the motor torque required to achieve a given rivet acceleration and/or velocity depends, at least in part, on the condition of the tool. That is, there is a variation in performance of the tool which depends, at least in part, on the condition of the tool. Compensation methods may be provided to compensate for this variation. Such compensation methods enable the provision of desired velocities (for example the required setting velocity during advance at speed 206) regardless of the condition of the tool. A number of compensation methods are described herein.

Figure 3:
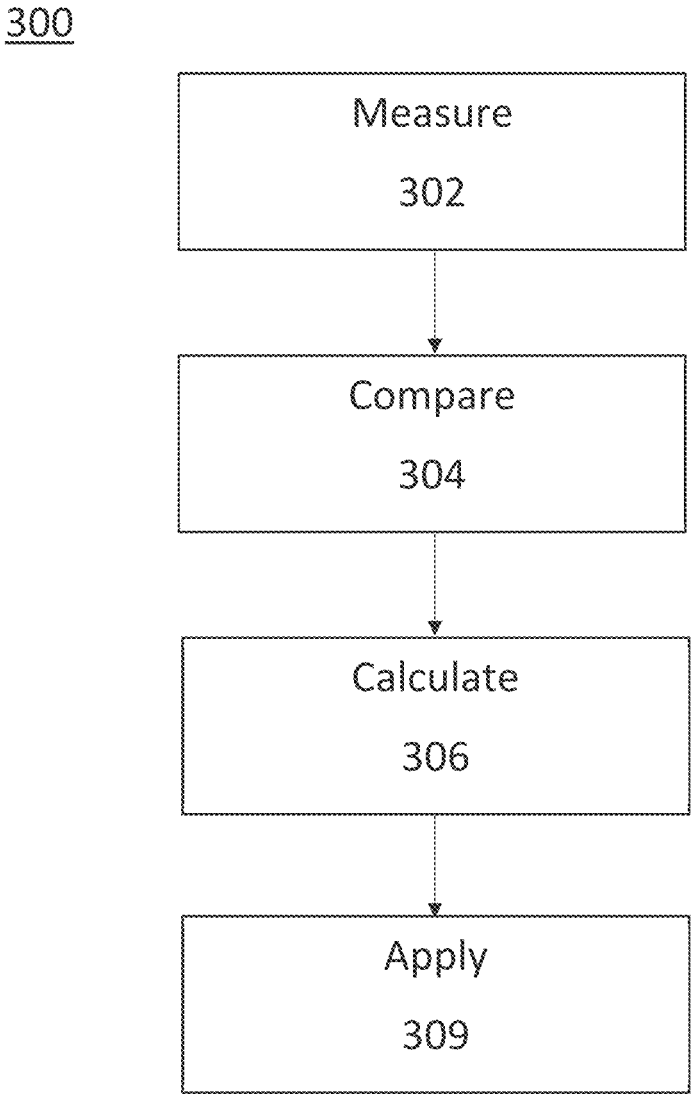
FIG. 3 shows an example compensation method.

FIG. 3 illustrates an example compensation method 300. The method 300, shown in FIG. 3, comprises measuring, at step 302, a parameter associated with a characteristic of the tool, comparing, at step 304, the measured parameter to a predetermined parameter value, calculating, at step 306, an adjustment based on the comparison, and applying, at step 309, the adjustment to the tool.

In more detail, using compensation method 300, a parameter associated with a characteristic of the tool is measured 302. The parameter that has been measured may be referred to herein as a measured parameter or a first parameter. The measured parameter comprises a value representing the characteristic, and hence may be referred to as a parameter value, first parameter value or measured parameter value. The characteristic associated with the measured parameter may be referred to herein as a first characteristic. The first parameter may be representative of the motion of the tool, for example it may be a speed or torque of the motor, or may be a velocity of the setter of the tool, or the speed of a rivet therein.

Measuring, at step 302, is performed when the characteristic associated with the measured parameter is substantially constant. By measuring when the characteristic is substantially constant, more accurate measurements may be obtained. A singe measurement may be made during the measurement step 302, or multiple measurements may be made during the measurement step 302. Additionally, further measurement steps may occur as described in more detail further below. For illustrative purposes, potential measurement steps 702*a-d*, 712*a-d* are illustrated in FIGS. 2A and 2B, which will be discussed in more detail further below.

After measuring at step 302, the measured parameter is compared, at step 304, to a predetermined parameter value. Comparing at step 304 may comprise a determination of the difference between the measured parameter and the predetermined parameter value. The difference between the first parameter and the predetermined parameter represents a condition of the tool, for example due to losses in the tool. It may be determined via the comparison that the measured parameter is less than the predetermined parameter value. For example, the predetermined parameter value may be the required setting velocity and it may be determined that the measured velocity is less than the required setting velocity. This comparison hence represents a sub-optimal (e.g. cold or warming) condition of the tool. Alternatively, the predetermined parameter value may be an expected velocity, and it may be determined that the measured velocity is less than an expected velocity. Again, this comparison represents a sub-optimal (e.g. cold or warming) condition of the tool.

After comparing, at step 304, the measured parameter and the predetermined parameter value, the method comprises calculating, at step 306, an adjustment. The adjustment is based on the comparison at step 304. The adjustment to be calculated is an adjustment to a characteristic of the tool. In particular, the adjustment is configured to compensate for the condition of the tool, such that the tool can be made to perform closer to an optimal performance despite a sub-optimal condition. For example, given the above examples wherein the measured velocity is less than the required setting velocity or less than an expected velocity, an adjustment to the tool may be calculated which will increase the setter velocity such that it reaches (or is closer to) the required setting velocity. The adjustment may be an adjustment to a second characteristic of the tool which is different to the first characteristic. It should be understood that the first and second characteristics are usually interdependent, for example motor torque and setter velocity.

Finally, the method 300 comprises applying, at step 309, the adjustment determined at step 306 to the tool. Applying, at step 309, the adjustment may comprise, for example, providing an instruction to the data processing system to increase the electrical stimulation provided to the motor, thereby increasing the motor torque and the setter velocity. The torque of a tool may be varied instantaneously, thereby resulting in a rapid adjustment.

The compensation method 300 can be used for velocity-based compensation and/or torque-based compensation.

In velocity-based compensation, the tool is accelerated to a velocity (e.g. a FAS velocity or required setting velocity) and maintained at that velocity (e.g. with a coast torque). The torque required to achieve and/or maintain the desired velocity is measured at a measurement step 302, and used for subsequent calculation and application of an adjustment. For example, the measured torque may be compared to an expected coast torque. The expected coast torque is the amount of torque which was expected to accelerate the tool to the desired velocity. The expected coast torque may be derived from measurements from previous insertion cycles and/or may be calculated e.g. via theoretical calculations. In velocity-based compensation, it is beneficial to perform the measurement step 302 when the velocity is substantially constant e.g. during an advance at speed phase 206 or FAS phase 202.

In torque-based compensation, the tool is initially accelerated using an applied torque. The applied torque is a torque which is expected to accelerate to and maintain the tool at a specific predetermined velocity (e.g. a required setting velocity) using a specified acceleration. Due to losses in the tool, the specific velocity may require a higher than expected torque to maintain the specific predetermined velocity. Using torque-based compensation, the velocity achieved and/or maintained by the tool given the applied torque may be measured and compared to the predetermined velocity, and an adjustment calculated and made based on the measured velocity. For example, it may be determined that a higher torque limit is required in order to achieve an optimal (e.g. flush) joint. In torque-based compensation, it is beneficial to perform the measurement step 302 when the torque is substantially constant. The torque is typically substantially within a phase, and experiences a discontinuous change between phases, so measurements may be taken at any point within a phase.

A first type of compensation method can be used during a single insertion cycle, and is hence referred to as in-cycle compensation. The above-described method 300 can be used as an in-cycle compensation method, wherein the measurement step 302 is performed during a first insertion cycle, and the adjustment is applied, in the applying step 309, to the tool during the same first insertion cycle.

Figure 4:
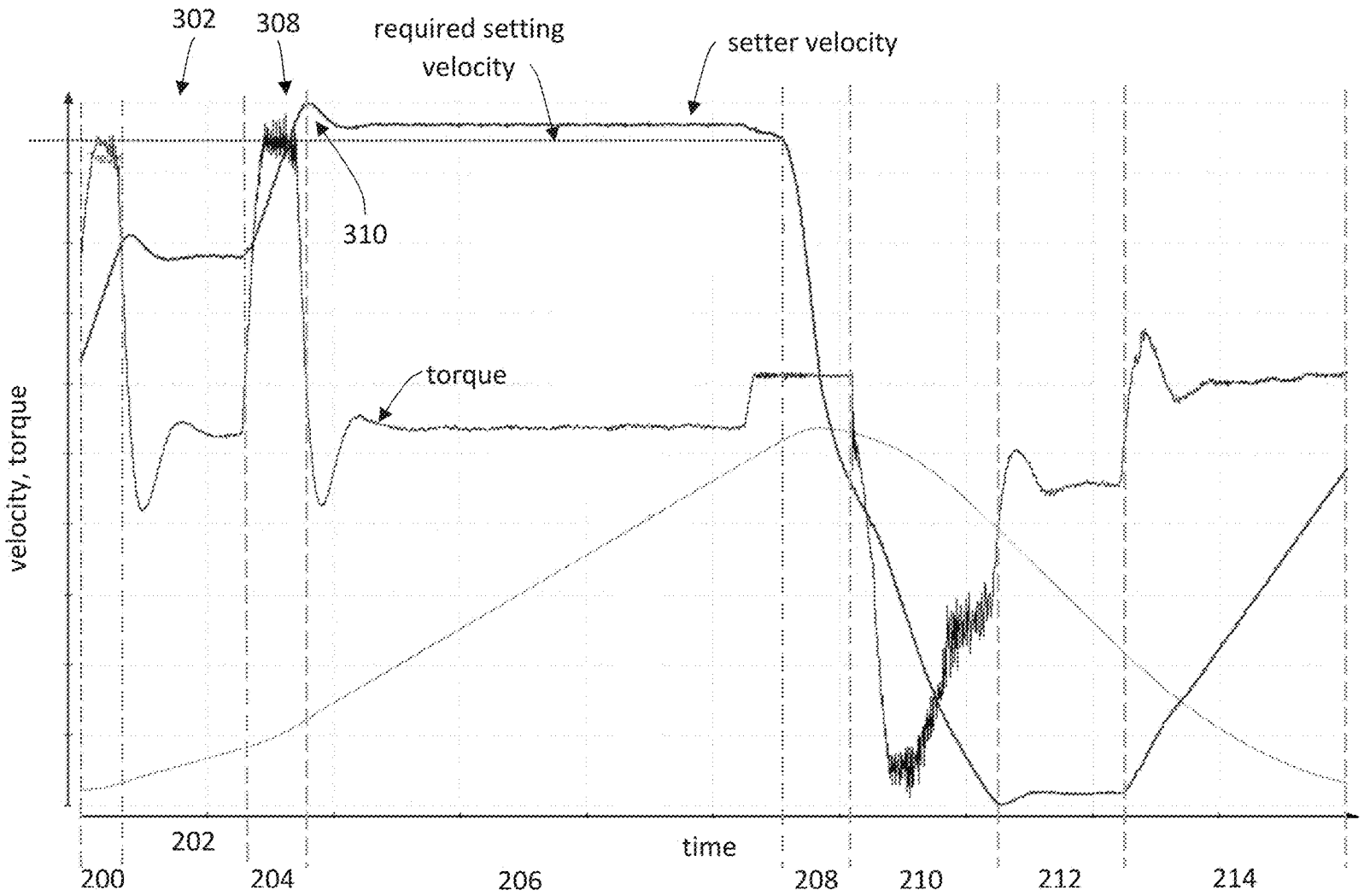
FIG. 4 illustrates the motor torque and setter velocity for an example insertion cycle of a tool using an in-cycle compensation method.

FIG. 4 depicts the use of an in-cycle compensation method used to achieve velocity-based compensation for an example cold or warming tool. FIG. 4 illustrates the motor torque and setter velocity for an example insertion cycle of a tool using an in-cycle compensation method in accordance with the compensation method 300 of FIG. 3.

The insertion cycle depicted in FIG. 4 is similar to that depicted in FIG. 2B and like features are numbered accordingly. However, in the insertion cycle depicted in FIG. 4, in the FAS phase 202 the setter velocity is less than the required setting velocity (as opposed to the setter velocity being greater than the required setting velocity).

The insertion cycle in FIG. 4 has an advance acceleration phase 200 wherein the tool is accelerated to a measurement velocity (the measurement velocity being less than the required setting velocity), a FAS phase 202 wherein the tool is maintained at the measurement velocity, a FAS acceleration phase 204 wherein the tool is accelerated to the required setting velocity, and an advance at speed phase 206 wherein the tool is maintained at the required setting velocity. It should be understood that a FAS acceleration phase 204 is equivalent to a FAS deceleration phase as described above, but with a negative deceleration.

In a measurement step 302 performed during the FAS phase 202, the torque required to maintain the measurement velocity is measured. The measured torque is compared, at a compare step 304, to an expected torque. In the example shown in FIG. 4, the comparison would determine that the torque required to maintain the measurement velocity was higher than expected, and hence the final setter velocity would need to be increased to compensate for the effects of losses (e.g. frictional losses) in the tool.

As such, an adjustment is calculated and applied. In particular, the adjustment is an acceleration provided to the tool, using the motor 10, during the FAS acceleration phase 204. This acceleration thereby provides an increased torque and hence an increased setter velocity.

Ideally (i.e. given an adequately calculated and applied adjustment), the setter velocity during the advance at speed phase 206 is substantially equal to the required setting velocity. The adjustment applied at step 309 may be greater than or less than the required setting velocity and referred to as overshoot or undershoot, respectively. Overshoot 310 can be seen in FIG. 4 wherein the tool is accelerated to a velocity slightly greater than the required setting velocity. Methods of controlling the change in setting velocity, thereby reducing the impact of overshoot and/or undershoot, are described in more detail further below.

Compensation methods as described herein may be particularly beneficial when used for calibrating tools, for example tools which are cold or warming. Such a calibration can compensate for a tool having a sub-optimal condition, and aid in achieving a setting velocity that will result in the required rivet insertion force for a given insertion cycle despite a sub-optimal condition of the tool. Therefore the change in the force and energy of the tool due to internal losses are compensated for using a compensation method which adjusts the mechanical inertia of the tool via a velocity change.

Figure 5:
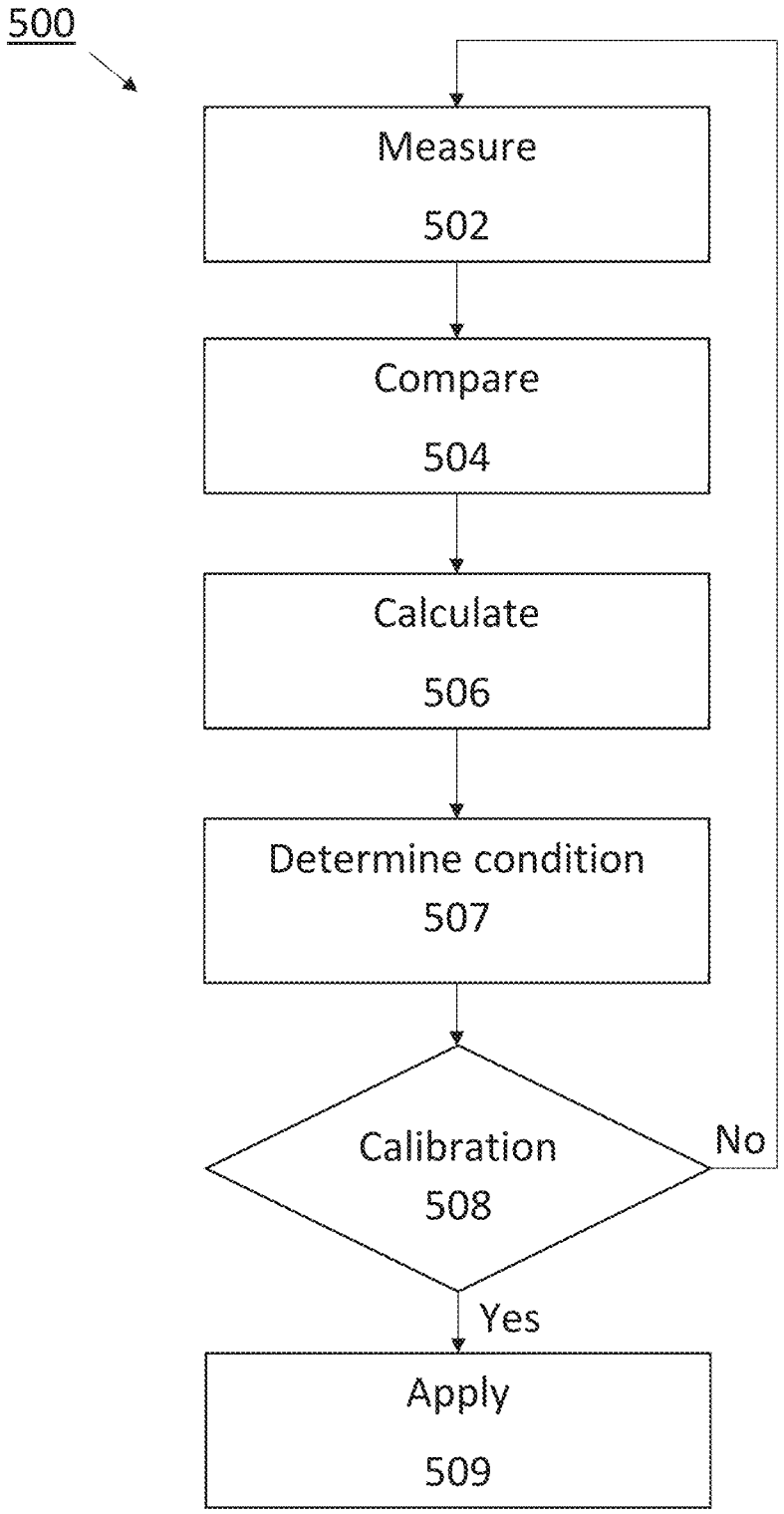
FIG. 5 shows an example compensation method.

FIG. 5 illustrates another example compensation method. In particular, the compensation method may be used for calibration and may be referred to as a calibrating compensation or a calibration. The compensation method 500 comprises measuring, at step 502, a parameter associated with a characteristic of the tool 2, comparing, at step 504, the measured parameter to a predetermined parameter value, calculating, at step 506, an adjustment based on the comparison, determining, at step 507, a condition of the tool, and determining at step 508 whether to perform a calibrating compensation. If it is determined at step 508 to perform a calibration, the method 500 applies, at step 509, the adjustment to the tool 2. If it is determined at step 508 to not perform a calibration, processing returns to step 502. The determination at step 508 is used to determine whether the condition of the tool 2 is such that the tool 2 requires a calibrating compensation and, if a calibration is necessary, applying, at step 509, the adjustment calculated at step 506.

The determination at step 508 may comprise a determination of whether the tool 2 is cold, warming or warm. Such a determination may be referred to as a condition determination. A condition determination may be performed by measuring a temperature of the tool 2. For example, temperature measuring means (not shown) may be provided on the tool 2 and the data processing system may receive or obtain a temperature from the temperature measuring means. Alternatively or additionally, a condition determination may be performed by measuring, calculating, or receiving a time since the last insertion cycle for the tool 2. Additionally or alternatively, a condition determination may use the comparison performed in step 504 i.e. based on the comparison between the measured parameter and the predetermined parameter value. Other condition determinations are also possible, as will be apparent to the skilled person, such as for example related to the overall age of the tool 2.

Processing may pass from step 508 to step 509 if the determined condition meets a predetermined criteria. For example, the determination at step 508 may compare a condition determined at step 507 with a predetermined optimal condition threshold. For example, the predetermined optimal condition threshold may be chosen to be a predetermined time e.g. 15 minutes. Subsequently, if the time since the last insertion cycle was performed exceeds the predetermined time, e.g. 15 minutes, then it may be determined that the tool is 'cold' or 'warming' and calibration is desired.

The determination step 507 has been illustrated as occurring after the measurement at step 502, comparison at step 504 and calculation of an adjustment at step 506. However, the determination at step 507 may occur at any other point in the process. For example, it may be beneficial to determine a condition of the tool prior to calculation of the adjustment, for example to reduce computational load on the data processing system.

The compensation methods as described above may be performed during normal operation of the tool 2 (e.g. while inserting rivets). The compensation methods may also be used for calibration with no rivet in the tool 2. For example, one or more 'dummy' runs may be performed when a tool is determined to be cold. One dummy run may be performed as a single calibration of the tool 2 prior to inserting a rivet. Alternatively, multiple dummy runs may be performed and the compensation method may be used in each of those runs. If performing multiple dummy runs, each performed with a compensation method, the difference between the measured parameter and predetermined parameter value, and hence the correction, should typically become smaller with each successive dummy run. A threshold may be chosen wherein, if the correction applied is deemed smaller than the threshold, the tool is considered 'warm' and ready for inserting a rivet. By using multiple dummy runs, a tool may be warmed up and accurately prepared for use, based on actual measured data.

Preferably, multiple measurements are made during a single measuring step (e.g. at steps 302, 502). By taking multiple consecutive measurements during a single measurement step, a more accurate adjustment may be calculated. Furthermore, by taking multiple measurements during a single measurement step, the effect of any errors in the measured parameter (for example due to variation in the performance of the tool and/or random errors associated with the measurement means) may be reduced.

If multiple measurements are taken during a single measurement step, these measurements may be processed to provide a single measured parameter. For example, the measured parameter may comprise an average of the multiple measurements. When taking multiple measurements during a single measurement step, a tolerance may be introduced to ensure stability between subsequent measurements. That is, if a single measurement in a series of measurements is outside a desired range (e.g. a measured velocity which is outside an error margin of ±3 mm/s compared to the setting velocity), the single measurement or the entire series of measurements may be omitted from future calculations. Alternatively, if a single measurement in a series of measurements is outside a desired range (e.g. outside an error margin of 5% compared to an average coast torque), the series of measurements may be halted and re-started. In this way, only substantially constant and/or reliable measurements are used to calculate an adjustment.

When multiple measurements are taken, each measurement may be provided with a weighting. The weighting may be referred to as a confidence value. The confidence value represents how closely a measured parameter value matches a theoretical parameter value. A formula may be used to calculate the theoretical value as approximate relationships between parameters of given tools and insertion cycle types may be known theoretically, or may be derived empirically based on use cases.

Equation 1 shows an example formula used to calculate a theoretical coast torque value $C_T$ for a specific tool and specific insertion cycle type. This equation may be derived empirically, for example based on use cases.

$$C_T = f(\text{Required setting speed}) \quad (1)$$

By comparing a measured coast torque with the theoretical coast torque $C_T$, the confidence value may be ascertained. When taking multiple measurements of a parameter, a confidence value may be calculated for each of the measured parameter values. A weighted average may be calculated for the multiple measurements, wherein each measurement may be weighted by its corresponding confidence value.

In some examples, an adjustment will not be applied unless the confidence value of one or more measurements is over a predetermined confidence threshold. In other examples, the adjustment may be weighted based on the magnitude of one or more of the confidence values.

In some instances, it may be beneficial to take the largest number of measurements possible within a phase of the insertion cycle, for example the advance at speed phase 206. For example, in an advance at speed phase 206 with a duration of 2.5 seconds and a measurement with a duration of 25 ms per measurement, 100 measurements may be performed during the advance at speed phase. In this way, the measurements may be performed, without a time penalty, during an advance at speed phase 206. A large number of measurements may result in a more accurate adjustment being calculated. Alternatively, it may be beneficial to reduce the number of measurements below the largest possible number. For example, a reduced number of measurements may advantageously reduce computational requirements and/or allow for halting and re-starting of measurements in the case of instabilities. A measurement step comprising six (6) or more measurements has been found to provide adequate data to calculate and apply a more effective adjustment than a single measurement. However, any number of measurements may be taken, for example one (1), twenty (20) or two-hundred (200).

In the example methods described above and with reference to FIGS. 3 to 5, an adjustment is calculated based on measurements taken during the current insertion cycle and the adjustment applied to the current insertion cycle. That is, the adjustment is applied to the same insertion cycle to that in which a parameter is measured.

Figure 6:
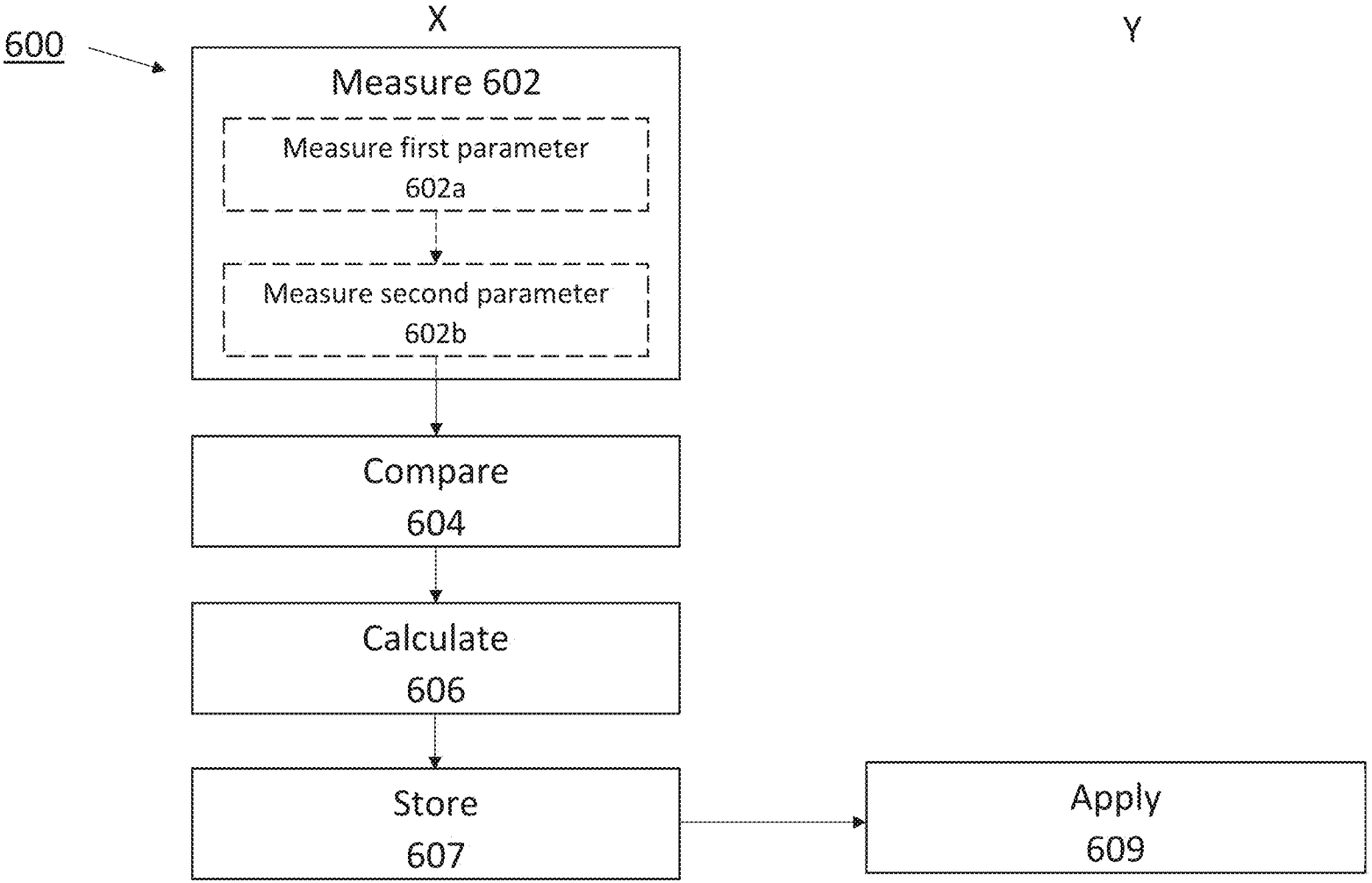
FIG. 6 shows an example compensation method.

FIG. 6 illustrates another example compensation method 600 wherein the adjustment is applied to a different insertion cycle to that in which a parameter is measured. The method 600 comprises measuring, at step 602, a parameter associated with a characteristic of the tool 2 in a first insertion cycle X, comparing, at step 604, the measured parameter to a predetermined parameter value, calculating, at step 606, an adjustment based on the comparison, storing, at step 607, the adjustment for example in a memory of the servo-controller, and applying, at step 609, the adjustment to the tool during a second insertion cycle Y. The same adjustment may be applied in a single second insertion cycle, or may be applied in multiple insertion cycles, for example for the next twenty cycles, or for a specific period of time, for example for the next 30 minutes.

The method 600 may further comprise, at the measurement step 602, measuring more than one parameter. For example, as depicted as optional steps of the method 600 in FIG. 6, the first measurement, at step 602, may further comprise measuring, at step 602*a*, a first parameter associated with a characteristic of the tool 2 and measuring, at step 602*b*, a second parameter associated with a characteristic of the tool 2. The first and second parameter may be associated with the same characteristic of the tool 2. The method 600 is not limited to two parameters and any number of measurements may be performed.

In FIG. 6, measurements are taken in the first insertion cycle X and applied during the second insertion cycle Y. Measurements may additionally be taken in the second insertion cycle Y. Such measurements taken in the second insertion cycle Y may then be compared to measurements taken in the first insertion cycle X and/or to predetermined values, in order to calculate the adjustment.

Figure 7:
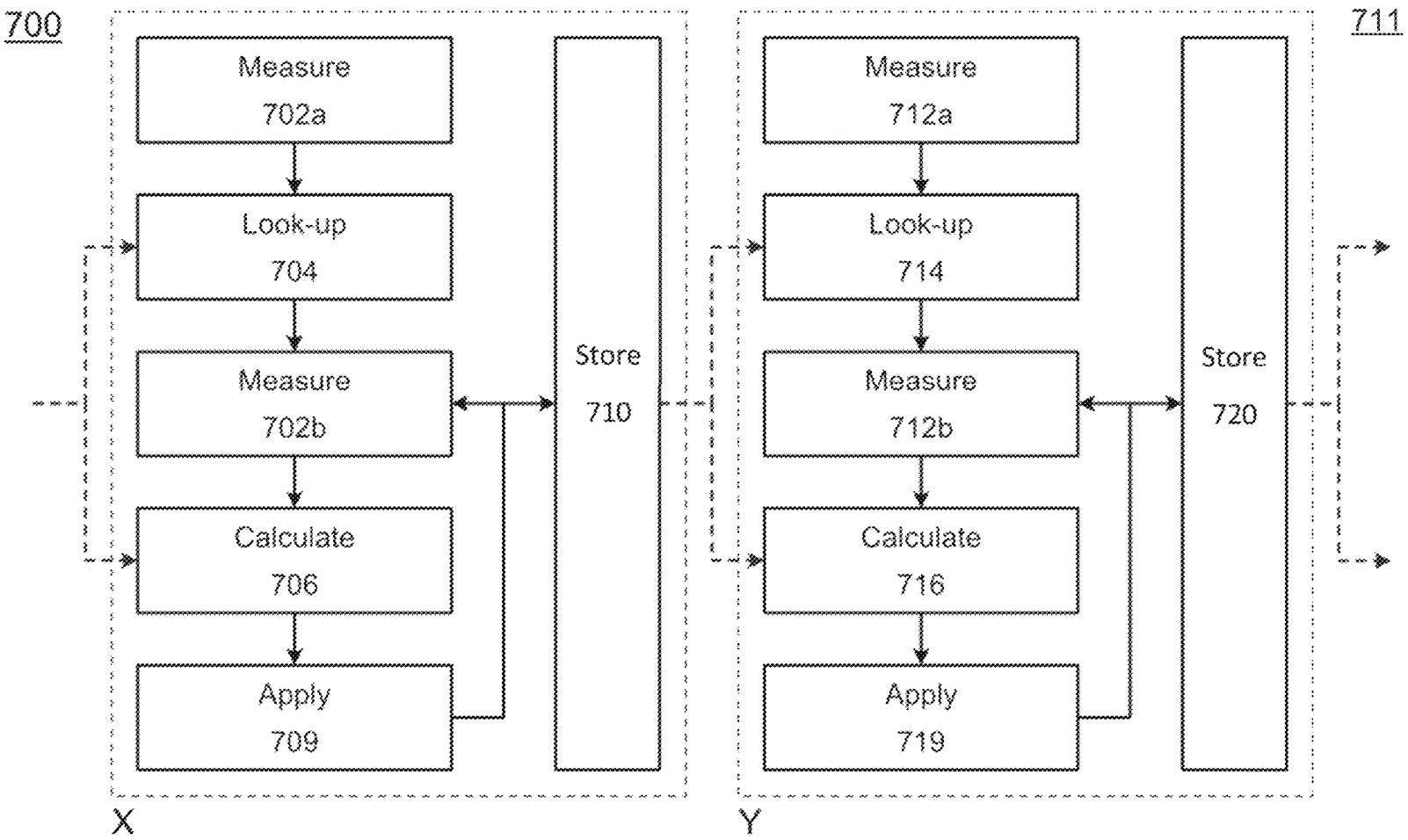
FIG. 7 shows an example compensation method.

FIG. 7 illustrates another example compensation method 700 wherein measurements are taken in both a first insertion cycle X and a second insertion cycle Y. The method 700 comprises, in the first insertion cycle X: measuring, at step 702*a*, a first parameter associated with a characteristic of the tool 2, performing a look-up, at step 704, to return an expected value for the first parameter; measuring, at step 702*b*, a second parameter, calculating, at step 706, an adjustment based on a comparison of the second parameter to the expected value; and applying, at step 709 and during the first insertion cycle X, an adjustment based on the calculation.

The steps of measuring the second parameter 702*b*, calculating 706 an adjustment based on a comparison of the second parameter to the expected value, and applying 709 the adjustment may be repeated multiple times while the system remains at constant velocity, for example during an advance at speed phase 206. That is, multiple measurements, calculations and hence corrections may be performed during such a phase, enabling greater control of the compensation applied to the tool. As such, if a first adjustment leads to an over-correction (e.g. using the example of the cycle depicted in FIG. 4, the velocity is increased above the required setting velocity) a subsequent one or more adjustments may be applied to further correct the parameters (e.g. to reduce the velocity to the required setting velocity).

When the first insertion cycle X has completed, one or more measured parameters and/or calculated adjustments may be stored in a look-up table (i.e. the look-up table accessed during step 704 of the compensation method 700). The updated look-up table is then accessed during a look-up step 714 of a compensation method 711 of a second insertion cycle Y.

The compensation method 711 of the second insertion cycle Y may be considered generally comparable to the compensation method 700 of the first insertion cycle X and comprises, in the second insertion cycle Y: measuring, at step 712*a*, a first parameter associated with a characteristic of the tool, performing a look-up, at step 714, to return an expected value for the first parameter; measuring, at step 712*b*, a second parameter, calculating, at step 716, an adjustment based on a comparison of the second parameter to the expected value; and applying, at step 719 and during the second insertion cycle Y, an adjustment based on the calculation. When the second insertion cycle Y has completed, one or more measured parameters and/or calculated adjustments may be stored in a look-up table (i.e. the look-up table accessed during step 714 of the compensation method 711). The updated look-up table is then accessed during subsequent cycles.

Hence, each insertion cycle may provide measurements which may be stored and used in the calculation of adjustments in future insertion cycles, forming a feedback loop. That is, a stored parameter measured in a previous insertion cycle may be considered a predetermined value to which a parameter measured in a current or future insertion cycle may be compared. For example, a measured value may be compared to an expected value which is considered to be a predetermined value. The stored values (i.e. stored parameters) can be used to monitor (and adjust for) the condition of the tool based on previous values associated with the tool based on such comparisons. The stored values may further be returned and used in the calculation of adjustments.

Two insertion cycles X, Y are shown in FIG. 7. However, it should be understood that additional insertion cycles may precede or succeed the depicted insertion cycles X, Y. As such, stored values may contribute to the comparison and/or calculations steps in a succeeding insertion cycle. Correspondingly, stored values from a preceding (but not shown) insertion cycle may contribute to the comparison and/or calculation steps 704, 706 in insertion cycle X. These processes are depicted using dotted arrows in FIG. 7.

The calculation of an adjustment in such a feedback loop beneficially reduces the impact of overshoot (as discussed above with reference to FIG. 4). Advantageously, by sampling data from previous insertion cycles, more accurate and reliable adjustments may be applied.

Use of the above-described methods 700, 711 will now be described with reference to the insertion cycles depicted in FIGS. 2A and 2B.

FIG. 2A illustrates an example scheme for taking measurements during an insertion cycle. In particular, the scheme for taking measurements comprises part of method 700 as described above, comprising two measurement steps 702*a*, 702*b*. FIG. 2A illustrates a measurement step 702*a* comprising a single measurement which takes place during the advance acceleration phase 200, and another measurement step 702*b* comprising multiple measurements which takes place during the advance at speed phase 206.

The parameters measured in the first and second measurement steps 702*a*, 702*b* are acceleration torque $A_M$ and coast torque $C_M$, respectively. Beneficially, the acceleration torque $A_M$ is measured during the advance at acceleration phase 200, during which the acceleration torque $A_M$ is substantially constant. Beneficially, the coast torque $C_M$ is measured during the advance at speed phase 206, during which the coast torque $C_M$ is substantially constant. The second measurement step 702*b* comprises measuring the coast torque $C_M$ eight times i.e. taking eight individual measurements. Stability and averaging processes as described above with reference to the taking of multiple measurements are performed so as to realise the aforementioned advantages of taking multiple measurements in a single measurement step.

The measurements as depicted in relation to FIG. 2A may be taken during a first insertion cycle X. The parameters measured during the first and second measurement step 702*a*, 702*b* of the first insertion cycle X may be referred to as the first and second parameters, respectively.

Additional insertion cycles, for example a second insertion cycle Y, may also be performed. The second insertion cycle Y is not depicted in FIG. 2A but may be considered generally comparable to the first insertion cycle X. During the second insertion cycle Y, a first and second measurement step 712*a*, 712*b* may be performed, again measuring acceleration torque $A_M$ and coast torque $C_M$, respectively. The parameters measured in the first and second measurement step 712*a*, 712*b* of the second insertion cycle Y may be referred to as the third and fourth parameters. The first and third parameters are acceleration torque $A_M$. The second and fourth parameters are coast torque $C_M$. Each measured acceleration torque $A_M$ measured in an insertion cycle has a corresponding coast torque $C_M$ measured in the same insertion cycle.

The above-described methods 700, 711 comprise a storage step 710, 710. That is, the first, second, third and/or fourth parameters may be stored. For example, they may be stored in a computer storage device associated with the tool 2. The acceleration torque $A_M$ and coast torque $C_M$ may be stored in a table, for example a look-up table, although it will be appreciated that any suitable data structure may be used. The stored data can then be used in further insertion cycles, for example returned in a look-up step and used for the calculation of adjustments.

FIG. 2B illustrates an example scheme for taking measurements during another insertion cycle, in particular an insertion cycle of FAS type. The scheme for taking measurements is similar to that described above and with reference to method 700, but comprises additional measurement steps. FIG. 2B illustrates a first measurement step 702*a* comprising a single measurement which takes place during the advance acceleration phase 200, a second measurement step 702*b* comprising multiple measurements which takes place during the FAS phase 202, a third measurement step 702*c* comprising a single measurement which takes place during the FAS deceleration phase 204, and a fourth measurement step 702*d* comprising multiple measurements which takes place during the advance at speed phase 206.

The parameters measured in the first, second, third and fourth measurement steps 702*a*, 702*b*, 702*c*, 702*d* are acceleration torque, FAS torque, FAS deceleration torque and coast torque. Beneficially, the acceleration torque and FAS deceleration torque measured during the advance acceleration phase 200 and FAS deceleration phase 204, during each of which the torque is substantially constant. Beneficially, the FAS torque and coast torque are measured during the FAS phase 202 and the advance at speed phase 206, during each of which the torque is substantially constant. The second measurement step 702*b* comprises measuring the FAS torque three times i.e. taking three individual measurements. The fourth measurement step 702*d* comprises measuring the coast torque four times i.e. taking four individual measurements. Stability and averaging processes as described above with reference to the taking of multiple measurements are performed so as to realise the aforementioned advantages of taking multiple measurements in a single measurement step.

The measurements as depicted in relation to FIG. 2B may be taken during a first insertion cycle X. The parameters measured during the first, second, third and fourth measurement steps 702*a*, 702*b*, 702*c*, 702*d* of the first insertion cycle X may be referred to as the first, second, third and fourth parameters, respectively.

Additional insertion cycles, for example a second insertion cycle Y, may also be performed. The second insertion cycle Y is not depicted in FIG. 2B but may be considered generally comparable to the first insertion cycle X. During the second insertion cycle Y, a first, second, third and fourth measurement step 712*a*, 712*b*, 712*c*, 712*d* may be performed. The parameters measured in the measurement steps 712*a*, 712*b*, 712*c*, 712*d* of the second insertion cycle Y may be referred to as the fifth, sixth, seventh and eighth parameters.

The above-described methods 700, 711 comprises a storage step 710, 720. That is, the first, second, third, fourth, fifth, sixth, seventh and/or eighth parameters may be stored.

For example, they may be stored in a computer storage device associated with the tool 2. The parameters may be stored in a table, for example a look-up table, although it will be appreciated that any suitable data structure may be used. The stored data can then be used in further insertion cycles, for example returned in a look-up step and used for the calculation of adjustments.

Figure 8:
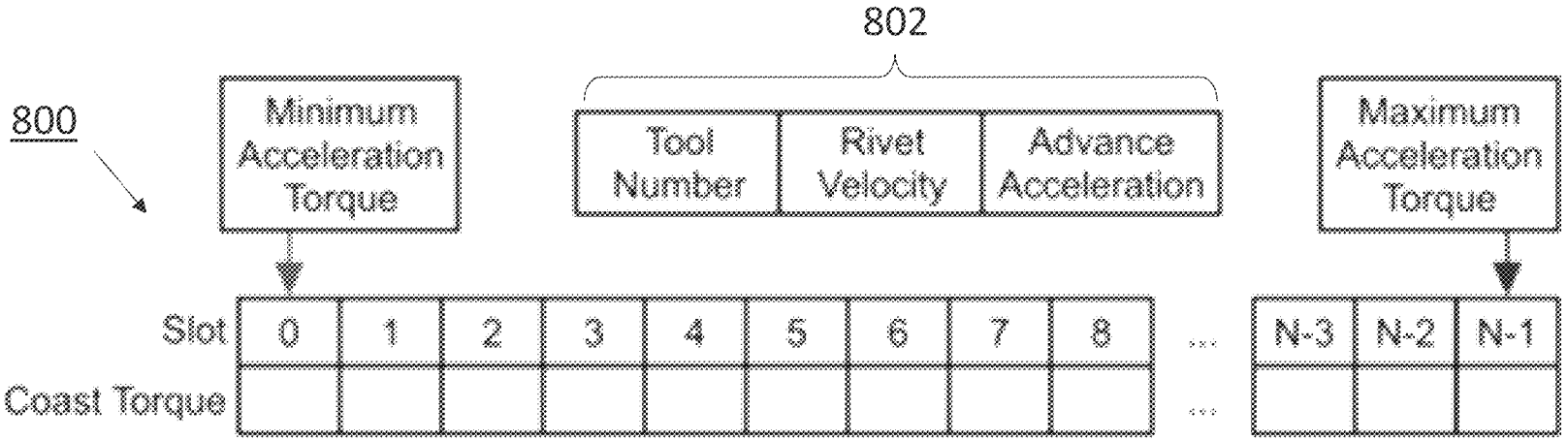
FIG. 8 depicts an example table used to store parameter values.

FIG. 8 depicts an example table 800 which may be used to store parameter values. In particular, the example table 800 stores the first, second, third, and fourth parameters, but it should be understood that similar tables may be used to store different parameters. The table is associated with specific characteristics 802 of the tool and/or insertion cycle, e.g. tool number, rivet setting velocity, acceleration rate, insertion cycle type etc. As such, there may be multiple other tables (i.e. a set of tables) similar in form to the example table 800, but storing different data depending on the specific characteristics of the tool. For example, the example table 800 may be associated with a first tool operating with a setting velocity of 100 mm/s, while a second table may be associated with the first tool operating with a setting velocity of 150 mm/s. Each table may have a table number T.

In use (i.e. when performing an insertion cycle on a tool, for example the insertion cycle depicted in FIG. 2A), a measurement of acceleration torque $A_M$ is taken during the advance acceleration phase 200. At a specific point during the advance acceleration phase 200, for example when a specific setter velocity is reached or a specific distance has been travelled by the setter, the motor torque is sampled and the acceleration torque value ($A_M$) calculated. Once the acceleration torque has been sampled, the measured acceleration torque $A_M$ is input as an index into a corresponding table (i.e. a table which corresponds to the specific characteristics of the tool). The corresponding table may be determined via a search of the set of tables. The determined table from the set of tables may be a table which is most closely compatible with the specific characteristics of the tool compared to other tables in the set of tables.

Using tables 800 such as that depicted in FIG. 8 provides a method of empirically determining an expected coast torque from a measured acceleration torque. For example, by storing previously measured values of a first parameter and corresponding (i.e. measured in the same insertion cycle as) measured values of a second parameter, an empirical relationship between the two parameters may be determined. In particular, the example in table 800 described herein is used to determine an empirical relationship between acceleration torque and coast torque may be determined. It should be understood, however, that depending on the choice of parameters, relationships between different parameters may be determined, for example FAS torque and acceleration torque, coast torque and torque limit etc.

Each table comprises a number N of columns or 'slots' in which data can be stored. The table 800 in FIG. 8 has slots numbered from zero (0) to N−1. A table may have, for example, 64 slots (i.e. N=64). The table 800 in FIG. 8 is arranged to store measured parameter values (in this instance, the second parameter coast torque $C_M$) in data storage locations. Each data storage location has a slot number corresponding to the column (i.e. slot) in which it is located. Each slot is an integer number.

Each table has two additional storage locations arranged to store a first storage parameter associated with the first slot (i.e. slot number zero (0)) and a final storage parameter associated with the final slot (i.e. slot number (N−1)). In FIG. 8, the first storage parameter is a minimum acceleration torque $A_{min}$ which represents a minimum value of acceleration torque $A_M$ associated with the tool given the specific characteristics 802 of the tool. The minimum acceleration torque $A_{min}$ may be predicted or may be based on previously measured values. In FIG. 8, the final storage parameter is a maximum acceleration torque $A_{max}$ which represents a maximum value of acceleration torque $A_M$ associated with the tool given the specific characteristics 802 of the tool. The maximum acceleration torque $A_{max}$ may be predicted or may be based on previously measured values.

The table 800 hence stores values of the second parameter (i.e. coast torque $C_M$) and a minimum and maximum value of the first parameter (i.e. acceleration torque $A_M$). Coast torque values $C_M$ are ordered such that they can be used and recalled when required. Coast torque values $C_M$ are ordered by assigning a slot number to each coast torque value $C_M$ and storing the coast torque $C_M$ value in its assigned slot. The slot number is assigned based on the acceleration torque value $A_M$ associated with (i.e. measured during the same insertion cycle as) the coast torque value $C_M$ and a comparison between the acceleration torque value $A_M$ and the maximum and minimum acceleration torque values $A_{max}$ $A_{min}$ stored in table 800. In FIG. 8, the table 800 is ordered from a coast torque value $C_M$ associated with a minimum acceleration torque $A_{min}$ in slot 0, to a coast torque value $C_M$ associated with a maximum acceleration torque $A_{max}$ in slot N−1.

The table 800 may be used in a storage process (for example storage steps 710, 720). The table 800 may also be used in a look-up process (for example look-up steps 704, 714) where a value may be selected from the table 800. In a look-up process, the selected value is output from the table 800 and may be used for a calculation step (for example calculation steps 706, 716). A look-up step or look-up process, for example the look-up steps 704, 714, may be referred to as a return process or table return, as a value is returned from the table 800 as an output.

With reference to the example insertion cycle shown in FIGS. 2A and 2B, numerous measurements can be taken throughout the rivet cycle, for example at measurement steps 702, 702*b*, up to the point at which the rivet touches the workpiece. The measured values can then be used to calculate and apply adjustments to characteristics of the tool. The initial measurement taken at measurement step 702*a*, during the initial acceleration phase 200, is used to generate an expected coast torque value via a look-up process and measurements taken at measurement step 702*b*, during the advance at speed phase 206, are compared to the expected coast torque value. An adjustment is calculated based on said comparison.

The storage and look-up processes will be described in more detail below.

Table Storage

The table 800 may initially be empty (i.e. the table 800 may hold no values). Alternatively, the table 800 may be populated with predetermined values, for example expected coast torque $C_M$ values from similar tools and/or calculations. For each new insertion cycle, for example the first insertion cycle Y, the table is populated with newly measured parameter values.

When the first parameter (i.e. acceleration torque value $A_M$) is measured, for example in measurement step 702*a* of insertion cycle Y, it is assigned a slot number. The slot number may be determined by comparing the measured acceleration torque $A_M$ to the stored values for the table's maximum and/or minimum acceleration torque $A_{max}$, $A_{min}$. For example, Equation 2 below uses the relationship between the measured acceleration torque $A_M$ and the minimum and maximum acceleration torque $A_{min}$, $A_{max}$ previously measured to determine the closest slot number. The slot number is denoted using an integer value S. The addition of 0.5 in equation 2 prior to taking the integer value (INT' operation) ensures the calculation selects the nearest whole number to the floating point calculation.

$$S = INT\left((N-1)\left(\frac{A_M - A_{min}}{A_{max} - A_{min}}\right) + 0.5\right) \quad (2)$$

If equation 2 calculates an integer value S within the range zero (0) to (N–1), the measured acceleration torque $A_M$ is assigned a slot number equal to the integer value S.

If the slot number lies outside the range 0 to (N–1), then the data table range would be adjusted.

If the calculated integer value S is less than zero (0) it signifies that the measured acceleration torque $A_M$ is lower than the previous measured minimum acceleration torque $A_{min}$. As such, if the calculated integer value is less than or equal to zero (0), the measured acceleration torque $A_M$ is assigned a slot number equal to zero (0). The measured acceleration torque $A_M$ is stored in the table 800 such that it overwrites the previously stored minimum acceleration torque $A_{min}$ (i.e. the minimum acceleration torque $A_{min}$ is set equal to the measured acceleration torque $A_M$). Rather than simply overwriting the stored minimum acceleration torque $A_{min}$ with the measured acceleration torque $A_M$, the minimum acceleration torque $A_{min}$ may be set using equation 3, which uses an offset. The offset is a small value compared to the measured acceleration torque $A_M$ and is used to prevent repeated recalculation of the slot numbers in the case of small changes to the minimum acceleration torque $A_{min}$.

$$A_{min}=\mathrm{MIN}(A_{min},(A_M-\mathrm{Offset})) \quad (3)$$

For example, if the acceleration torque limits were 100% to 150%, an offset of 5% is used, and the measured torque is 95% then the limits would be modified to be 90% to 150%.

If the calculated integer value S is higher than (N–1), it signifies that the measured acceleration torque $A_M$ is higher than the previous measured maximum acceleration torque $A_{max}$. As such, if the calculated integer value S is higher than or equal to (N–1), the measured acceleration torque $A_M$ is assigned a slot number equal to (N–1). The measured acceleration torque $A_M$ is stored in the table 800 such that it overwrites the previously stored maximum acceleration torque $A_{max}$ (i.e. the maximum acceleration torque $A_{max}$ is set equal to the measured acceleration torque $A_M$). Rather than simply overwriting the stored maximum acceleration torque $A_{max}$ with the measured acceleration torque $A_M$, the maximum acceleration torque $A_{max}$ may be set using equation (4), which uses an offset. The offset is a small value compared to the measured acceleration torque $A_M$ and is used to prevent repeated recalculation of the slot numbers in the case of small changes to the maximum acceleration torque $A_{max}$.

$$A_{max}=\mathrm{MAX}(A_{max},(A_M+\mathrm{Offset})) \quad (4)$$

Following recalculation of the minimum and/or maximum acceleration torque $A_{min}$, $A_{max}$, the slot numbers S are recalculated based on the new acceleration torque range. Any values stored in slots 1 to N–1 may subsequently be shifted to higher or lower valued slots, for example to account for the change.

Subsequently, when the second parameter (i.e. coast torque value $C_M$) is measured, for example in measurement step 702*b* of insertion cycle X, it is assigned the same slot number as was designated for the measured acceleration torque $A_M$. For example, if the slot number S determined using equation 2 was S=15, then the measured second parameter is also assigned slot number S=15.

If the determined slot (e.g. slot number S=15) in the table 800 is empty, the coast torque value $C_M$ is inserted into the empty slot unmodified. If a value already exists in the slot, for example a previously measured value or an initialised predetermined value, the value may be overwritten, for example to maintain an up-to-date table of values, or a new value may be calculated and inserted into the determined slot, for example a new value calculated based on the previously measured value and/or initialised predetermined value and the new measured value.

This process may be repeated for additional insertion cycles (e.g. Y etc.) so as to store measured coast torque values $C_M$ associated with a tool with specific characteristics 802 for multiple iterations of a specific insertion cycle type. Each time an insertion cycle is performed, the acceleration torque $A_M$ is measured, a slot number is calculated, the coast torque $C_M$ is measured, and the coast torque $C_M$ (or a value calculated thereupon) is added to the table 800 at the calculated slot number. For example, if the calculated slot number is 56, the coast torque $C_M$ is added to the table 800 at slot 56. Over time, Table 1 will therefore indicate a series ordered of coast torque values $C_M$ which have been measured during previous insertion cycles.

It should be noted that, occasionally, a tool may perform an insertion cycle for which no corresponding table exists (e.g. if no table exists that is associated with the specific characteristics of this tool and insertion cycle). If no table exists, a new table may be created. One or more of the slots in the new table may be empty or may be initialised with predetermined values. For example, the new table may comprise an estimated maximum and/or minimum acceleration torque $A_{max}$, $A_{min}$. The estimated maximum and/or minimum torque $A_{max}$, $A_{min}$ may be calculated using the maximum and/or minimum torque $A_{max}$, $A_{min}$ of an existing table with specific characteristics similar to those associated with the new table. Alternatively, the estimated maximum and/or minimum torque $A_{max}$, $A_{min}$ may be calculated based on an offset from the measured acceleration torque ($A_M$).

Furthermore, it should be noted that the values stored in the table 800 may be stored in original form, or may be stored following processing (e.g. normalisation).

Table Return

After being populated, for example using the above-described method, table 800 comprises a series ordered of coast torque values $C_M$ which have been measured during previous insertion cycles. As such, values from the table 800 can be returned and used in comparisons between measured values and returned values, which can subsequently be used to calculate adjustments. The return process will be described herein with reference to the second insertion cycle Y, for example as described with reference to FIGS. 2A, 7 and 8.

When the third parameter (i.e. acceleration torque value $A_M$) is measured, for example in measurement step 712*a* of insertion cycle Y, it is assigned a slot number. The slot number may be determined by comparing the acceleration torque $A_M$ to the stored values for the maximum and/or minimum acceleration torque $A_{max}$, $A_{min}$ stored in the relevant table 800. For example, equation 2 may be used to determine a slot number via an integer value S.

Based on the assigned slot number, the table 800 will return an expected coast torque $C_E$ as an output to the return process, for example in look-up step 714. The expected coast torque $C_E$ comprises a coast torque value stored in a slot of the table 800, or a value derived therefrom. That is, the slot number for the expected coast torque $C_E$ is calculated based on where the measured acceleration torque $A_M$ measured during the measurement step 712*a* (i.e. the third parameter) lies between the minimum and maximum limits (i.e. maximum and minimum acceleration torque $A_{max}$, $A_{min}$). The expected coast torque ($C_E$) may be returned from the table 800 using equation 5:

$$C_E = \text{Table}[T] \cdot \text{Data}[S] \quad (5)$$

If a slot number S is calculated to be within the range zero (0) to (N−1), the measured acceleration torque $A_M$ is assigned a slot number equal to the integer value S and the coast torque stored at that slot returned accordingly.

If the expected coast torque value is zero, or another null value, it indicates that no data exists in that slot. For example, this may indicate that no sufficiently similar insertion cycle has been performed. In this instance, an expected coast torque $C_E$ may be returned based on a calculation including other stored coast torque values $C_M$, either in this table 800 or in another table associated with similar specific characteristics. The expected coast torque $C_E$ may be calculated using a coast torque formula derived for the specific tool assembly using equation 6.

$$C_E = f(\text{Required setting speed}) \quad (6)$$

If a slot number S is calculated to be outside the range of zero (0) to (N−1), then the table is modified to fit new limits (as described above with reference to Table Storage). An expected coast torque $C_E$ may then be estimated.

If a slot number S is calculated to be less than zero (0), this signifies that the measured acceleration torque $A_M$ is lower than the previously measured minimum acceleration torque $A_{min}$. As such, if the integer value is less than zero (0), the stored coast torque value $C_M$ in slot zero (0) may be returned as the expected coast torque $C_E$. Alternatively, an expected coast torque $C_E$ may be returned based on a calculation including the stored coast torque value $C_M$ in slot zero (0). For example, the calculation may comprise the stored coast torque value $C_M$ in slot zero (0) minus an offset. The offset may be weighted based on the magnitude of the calculated integer value S.

Correspondingly, if a slot number S is calculated to be greater than (N−1), this signifies that the measured acceleration torque $A_M$ is higher than the previously measured maximum acceleration torque $A_{max}$. As such, if the integer value is greater than (N−1), the stored coast torque value $C_M$ in slot (N−1) may be returned as the expected coast torque $C_E$. Alternatively, an expected coast torque $C_E$ may be returned based on a calculation including the stored coast torque value $C_M$ in slot (N−1). For example, the calculation may comprise the stored coast torque value $C_M$ in slot (N−1) plus an offset. The offset may be weighted based on the magnitude of the calculated integer value S.

The returned expected coast torque $C_E$ may be returned in the form in which it was stored, or may be further processed before (or as part of) being returned. For example, if the value was normalised before storage, it may be un-normalised before being returned. Additionally or alternatively, a coast torque value may be interpolated with a value in an adjacent slot.

After the expected coast torque $C_E$ is returned form the table 800, it can be used to calculate an adjustment (e.g. at step 716). A fourth parameter is measured, at step 712*b*. In this example, the fourth parameter is coast torque $C_M$. The difference between the measured coast torque $C_M$ and the expected coast torque $C_E$ returned in the look-up step is indicative of the condition of the tool at the time of measurement. How this measured coast torque $C_M$ varies from the expected coast torque $C_E$ can be used to determine the amount of compensation required during a specific riveting cycle. For example, an adjustment may be calculated based on the difference between the measured coast torque $C_M$ and the expected coast torque $C_E$.

The adjustment may comprise, for example, providing an instruction to the data processing system to increase the electrical stimulation provided to the motor, thereby increasing the coast torque to a value which more closely matches the desired coast torque. The adjustment may be calculated dependent on the difference between the expected coast torque $C_E$ and the desired coast torque. The calculated adjustment may then be applied to the tool (e.g. at step 719). The adjustment may be an adjusted electrical stimulation provided to the motor. In this way, parameters measured in a previous insertion cycle may be used to calculate and apply an adjustment in a current insertion cycle. Beneficially, this enables a tool to compensate for losses based on data collected in previous similar insertion cycles, leading to effective and accurate adjustments.

Preferably, the acceleration torque $A_M$ measured in measurement step 712*a* and measured coast torque $C_M$ measured in measurement step 712*b* are also stored in the table, such that they can be used (e.g. to reorder the table 800 and/or be returned) in future insertion cycles.

A compensation method of this type may operate in a "measuring-only" mode (i.e. where values are measured in each cycle and stored in tables). Alternatively, the compensation method may operate in an "adjustment-only" mode (i.e. where adjustments are applied based on previously stored values, but no new measurements are stored).

Alternatively, both measuring and adjustments are used in a single cycle. That is, in a plurality of first cycles, measurements are taken and stored. These measurements are used in a first cycle to calculate and apply an adjustment in the first cycle and are also stored for use in a second cycle to calculate and apply an adjustment in the second cycle. Similarly, the measurements taken in the second cycle can be used in the second cycle to apply an adjustment in the second cycle and are also stored for use in a further cycle to calculate and apply an adjustment in the further cycle. A compensation method of this type beneficially provides a constant feedback system to compensate for losses based on real measurements.

Figure 9:
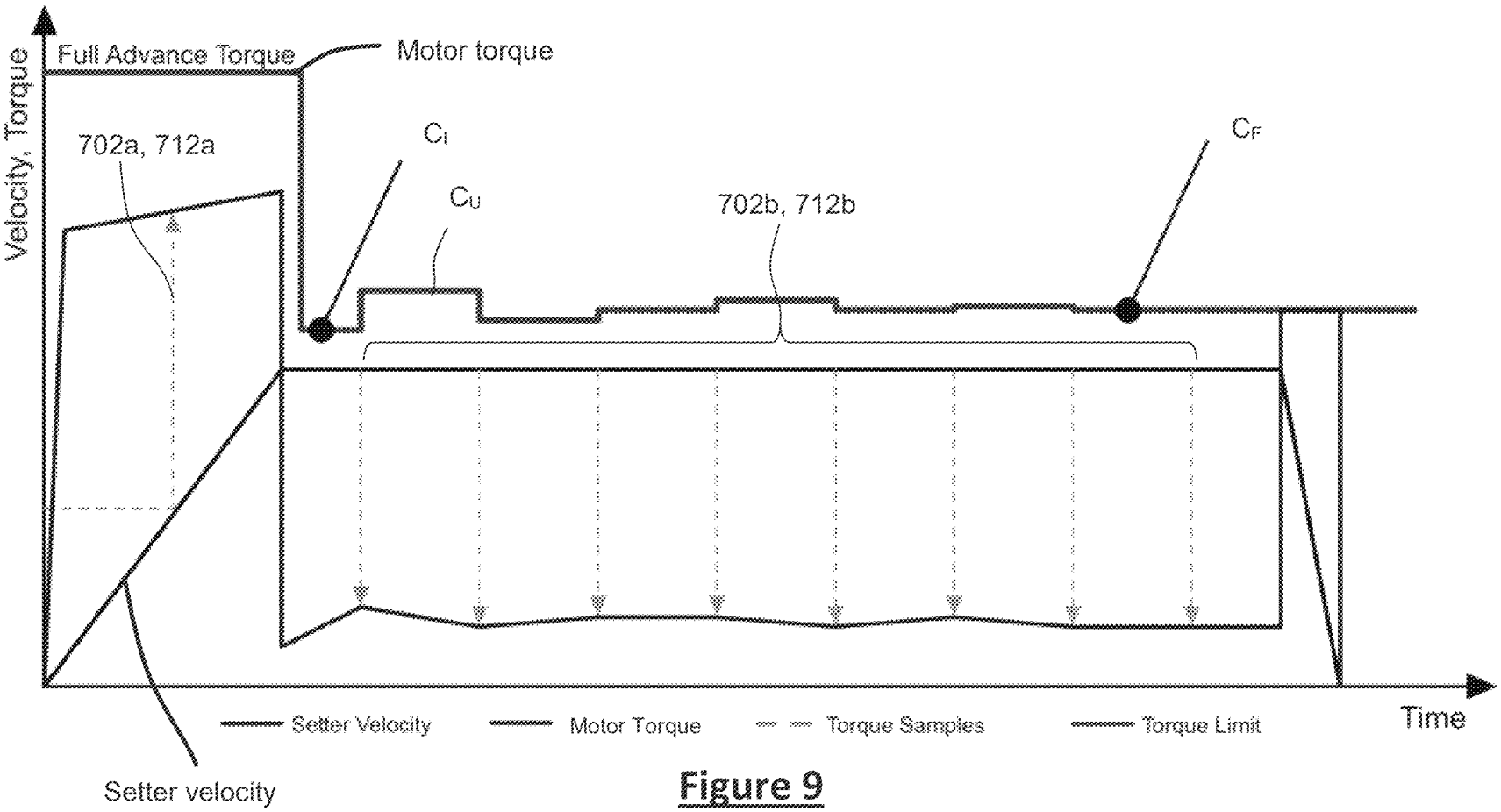
FIG. 9 illustrates a method used to increase the confidence in a calculated adjustment.

FIG. 9 illustrates a method which may be used to increase the confidence in measurements, thereby increasing the confidence in a calculated adjustment. In particular, the method can be used to increase the confidence in sampled measurements when taking multiple measurements in a single measurement step. In particular, FIG. 9 depicts a portion of an insertion cycle wherein a first measurement step 702*a*, 712*a*, comprising a single measurement, is performed during the advance acceleration phase 200 and a second measurement step 702*b*, 712*b*, comprising multiple measurements, is performed during the advance at speed phase 206.

Each individual measurement of the second measurement step 702*b*, 712*b* is used as a sample to sample the coast torque $C_M$ during different times/distances within the advance at speed phase 206. A sampling enhancement is performed after each measurement of the second measurement step 702*b*, 712*b*.

Each measurement in the second measurement step 702*b*, 712*b* is allocated a confidence value. A specific measurement is given a higher confidence value if there is a high correlation between the expected coast torque (e.g. as returned from a table 800) and the specific measured coast torque value. Alternatively or additionally, a specific measurement may be given a higher confidence value if there is a high correlation between previously measured coast torque values (e.g. coast torque values measured earlier in the second measurement step 702*b*, 712*b*) and the specific measured coast torque value. Alternatively or additionally, newer (i.e. more recent) measurements may be given a higher confidence value compared to older measurements, for example measurements taken in previous insertion cycles.

A weighted average value for coast torque $C_{MA}$ is calculated from a weighted average from all the coast torque data sampled in the second measurement step 702*b*, 712*b*. The weighted average value for coast torque $C_{MA}$ is updated after each measurement in the second measurement step 702*b*, 712*b*. Each measurement is weighted based on its confidence value and confidence values for each of the subsequent coast torque measurements. The weighted average coast torque $C_{MA}$ can be calculated using equation 7.

$$C_{MA} = \frac{\sum(\text{Coast Torque measurement} \times \text{Confidence Value})}{\sum(\text{Confidence Values})} \quad (7)$$

Comparing the expected coast torque $C_E$ to the average coast torque $C_{MA}$ and measured coast torque for each sample, loss in the tool (e.g. due to the setter condition) can be estimated. Such estimations may be used to modify the coast torque provided to the tool during the advance at speed phase 206. For example, the coast torque can be updated from an initial coast torque $C_I$ (i.e. the coast torque value measured in the sampling step) to an updated clamp limit $C_U$ using equation 8. K is a compensation factor and may, for example, be in the range of 1 to 1.25:

$$C_U = C_I + (K \times (C_{MA} - C_E)) \quad (8)$$

Due to the method in which the clamp torque is applied, there is negligible delay between the measurement of torque and an application of an adjustment to the torque, so the compensation can be performed within the same insertion cycle.

This process can be performed multiple times to iteratively enhance the torque. For example, in FIG. 9 the process is performed eight (8) times such that the coast torque is adjusted eight (8) times, finally reaching a final coast torque $C_F$. The final coast torque $C_F$ will likely have a higher confidence value than the previous coast torque values, due to the multiple adjustments made. That is, the final coast torque will be closer to the expected coast torque than the initially measured coast torque due to the sampling enhancement performed.

Subsequently, when average value for coast torque $C_{MA}$ may be inserted into the table (e.g. table 800) at the assigned slot number based on the previously measured acceleration torque $A_M$ measured in the first measurement step 702*a*.

At the end of the rivet cycle, this final calculated average coast torque $C_{MA}$ value would be stored into the torque table at the previously calculated slot position. If the slot already contains a coast torque value $C_M$, then the average coast torque $C_{MA}$ may be incorporated into the slot via a simple n-point running average nRA. The n-point running average may be represented by equation 9, with the averaging value n (which may be, for example, eight (8)).

$$nRA = \frac{(n-1) \times C_M + C_{MA}}{n} \quad (9)$$

Variations to the above-described sampling enhancement can be used and may include an intelligently smoothed running average method as described below. Such a sampling enhancement is provided to improve the reliability of the data sampled, and to minimize sampling errors.

Figure 10:
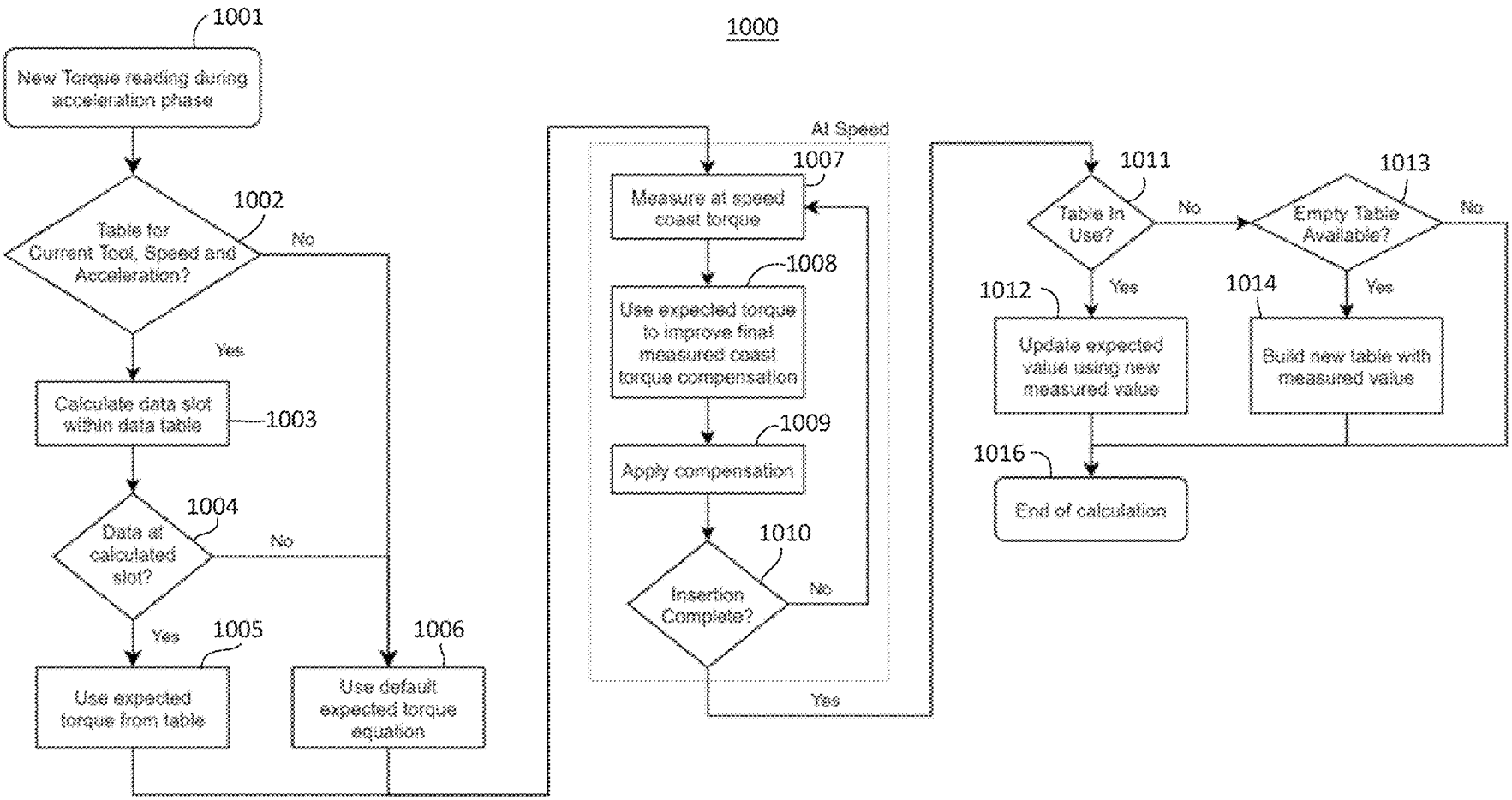
FIG. 10 shows an example compensation method.

FIG. 10 depicts an example compensation method 1000. The example compensation method incorporates many of the methods and processes described above.

At a first step 1001, a new torque reading (i.e. acceleration torque) is measured during the advance acceleration phase.

At a second step 1002, a determination is made as to whether a table exists which corresponds to the current tool and insertion cycle (e.g. current tool type, required insertion velocity (speed) and acceleration).

If the determination in the second step 1002 is that a table exists, a data slot of said table is calculated, at a third step 1003. The data slot, for example a slot number S, can be calculated as described above.

At a fourth step 1004, a determination is made as to whether there is data stored in the calculated data slot. For example, the data may have been stored during a previous insertion cycle.

If data exists, said data is returned from the table as an expected coast torque value in a fifth step 1005.

If the determination in the second step 1002 is that no table exists, the method skips to a sixth step 1006. At the sixth step 1006, an expected torque value is returned, which may be based on an expected torque equation, for example equation 6.

At a seventh step 1007, a new torque reading (i.e. coast torque) is measured during the advance at speed phase.

At an eighth step 1008, the new torque reading is compared to the expected coast torque. The comparison is used to generate an adjustment to the coast torque to compensate for losses in the tool. That is, the adjustment is a calculated compensation to be applied.

At a ninth step 1009, the compensation is applied to the tool.

At a tenth step 1010, a determination is made as to whether the insertion (i.e. the insertion of a fastener into a workpiece) is complete. This determination may be performed based on a measurement of time, setter and/or rivet location, or any other method.

If the insertion is incomplete, the seventh through tenth step 1007-1010 are repeated. By repeating these method steps 1007-1010, the tool may be iteratively compensated, thereby providing a more accurate overall compensation.

If the insertion is complete, the method proceeds to an eleventh step 1011.

At the eleventh step 1011, a determination is made as to whether a table is in use. The determination may be recalled from the second step 1002.

If a table is in use, the expected torque value in said table is updated, at a twelfth step 1012, using the new measured coast torque value. As described above, the new measured coast torque value may overwrite the previous expected torque value, or a new value may be generated and inserted into the table based on the new and previous values, for example using an nRA.

If the determination in the eleventh step 1011 is that a table is not in use, the method proceeds to a thirteenth step 1013, wherein a determination is made as to whether an empty table is available. That is, a predetermined number of tables may be in use depending on the storage capacity of a computer storing said tables.

If an empty table is available, a new table is built, at a fourteenth step 1014, with the new measured coast torque value inserted within.

If no empty table is available, the process ends 1016. The existence of no empty table may signify that enough data has been added and more data is not required at this stage. Alternatively, an indication may be provided that more storage is required.

The process also ends 1016 after the storage of a value in a table, for example at the twelfth or fourteenth step 1012, 1014. At this point, the value is available to be returned in a future insertion cycle, for example during a fifth step 1005 where an expected torque value is returned from the table.

Figure 11A:
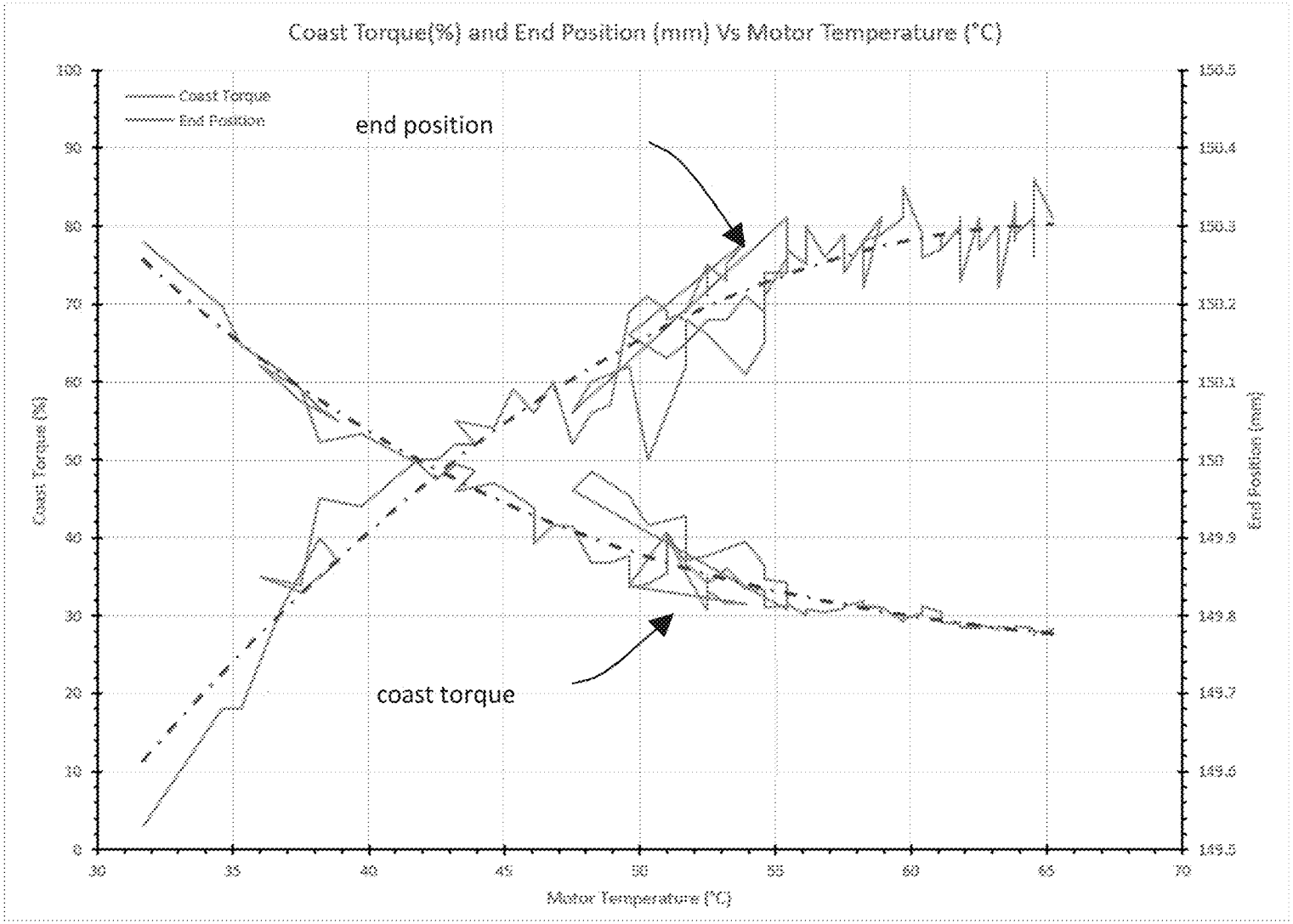
FIG. 11A shows data from a fastener setting tool with no compensation method used.
Figure 11B:
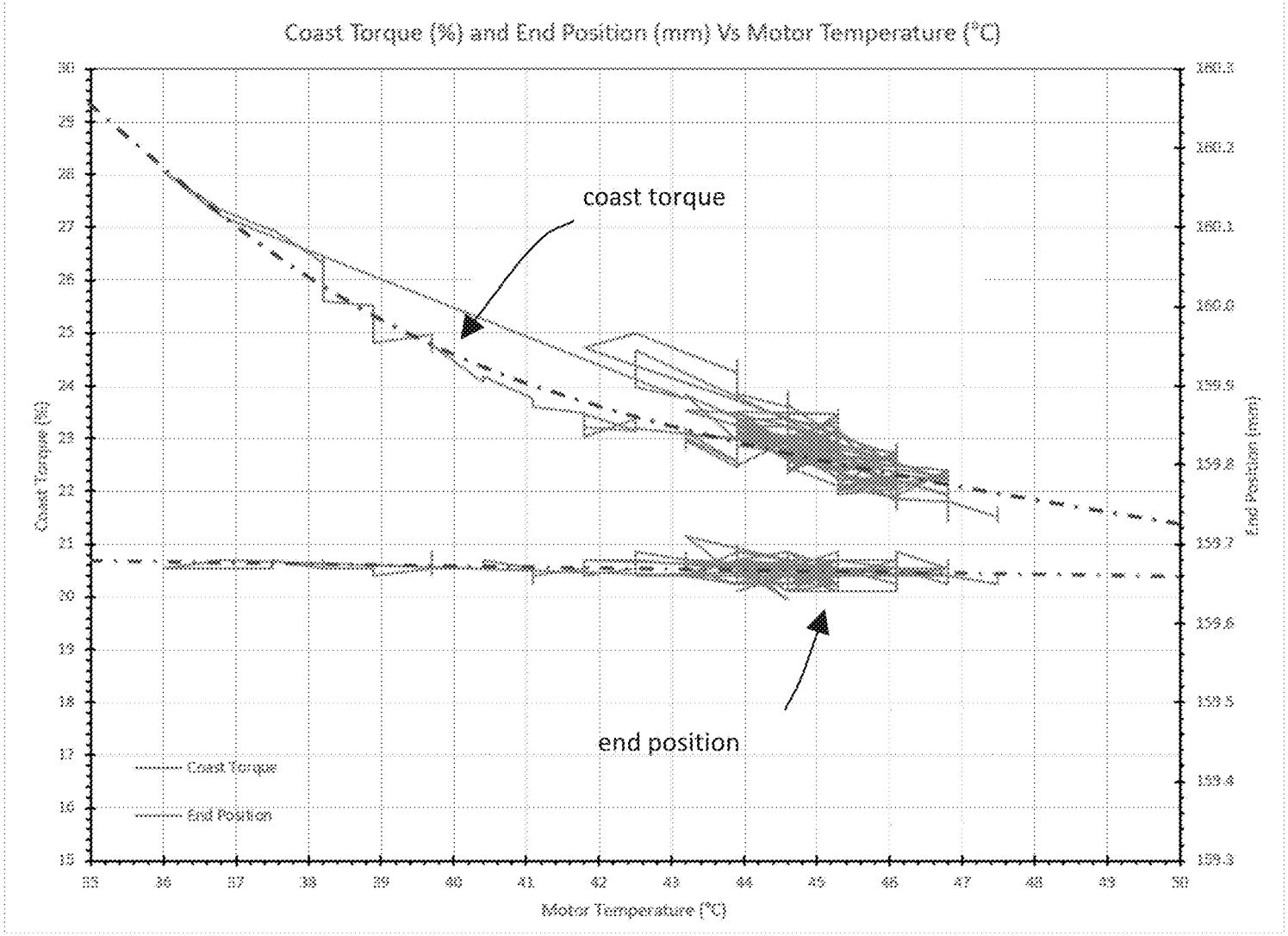
FIG. 11B shows data from a fastener setting tool using a compensation method.

FIGS. 11*a* and 11*b* depict example data from a real tool using the method 1000 as described herein.

The effect of the compensation method 1000 is illustrated in FIGS. 11A and 11B. FIG. 11A shows data from a known tool with no compensation methods used. FIG. 11B shows data from a similar tool using a compensation method 1000 as described above. The data shows measured coast torque values and measured end position values, with the same scale, as the tools warm up. The end position may be used as a measure of the accuracy of control of the tool. In ideal process, the end position for the first cycle should match that for a subsequent cycle irrespective of the tool's condition. Variations in the end position may indicate that losses were not compensated for effectively resulting in a change in the setting force/energy.

It can be seen from FIGS. 11A and 11B that, when using no compensation methods, the end position may vary by approximately 0.8 mm while the tool is warming. This variation is reduced to 0.05 mm when using a compensation method as described herein. This reduction in end position variation indicates that losses have been significantly compensated for.

Intelligently Smoothed Running Average

Smoothing may additionally be used to improve the reliability of measurements and therefore the reliability and accuracy of adjustments. Smoothing is particularly useful when multiple measurements are performed in a single measurement step, for example in the second measurement step 702*b*, 712*b* as described above. A running average (weighted or un-weighted) may be determined as each measurement is performed, and said average may be smoothed as described below.

A smoothed running average sRA is typically reset after any step change in a parameter is experienced, for example due to a change in the riveting phase such as the discontinuous change in torque between an advance acceleration and an advance at speed phase. When reset, a count number M is reset to 1. The count M is iteratively increased each time a new measurement $J_M$ is made. The count M is increased from 1 to a desired smoothing factor F (F is the period of smoothing and may be, for example, 24). The smoothed running average sRA is iteratively updated from a previous running average $sRAM_{M-1}$ to an updated running average $sRA_M$ after each measurement $J_M$ is taken, using equations 10 and 11.

$$sRA_M = \frac{sRA_{M-1} \times (M-1) + J_M}{M} \tag{10}$$

$$M = \text{Minimum}(F, (M+1)) \tag{11}$$

Figure 12:
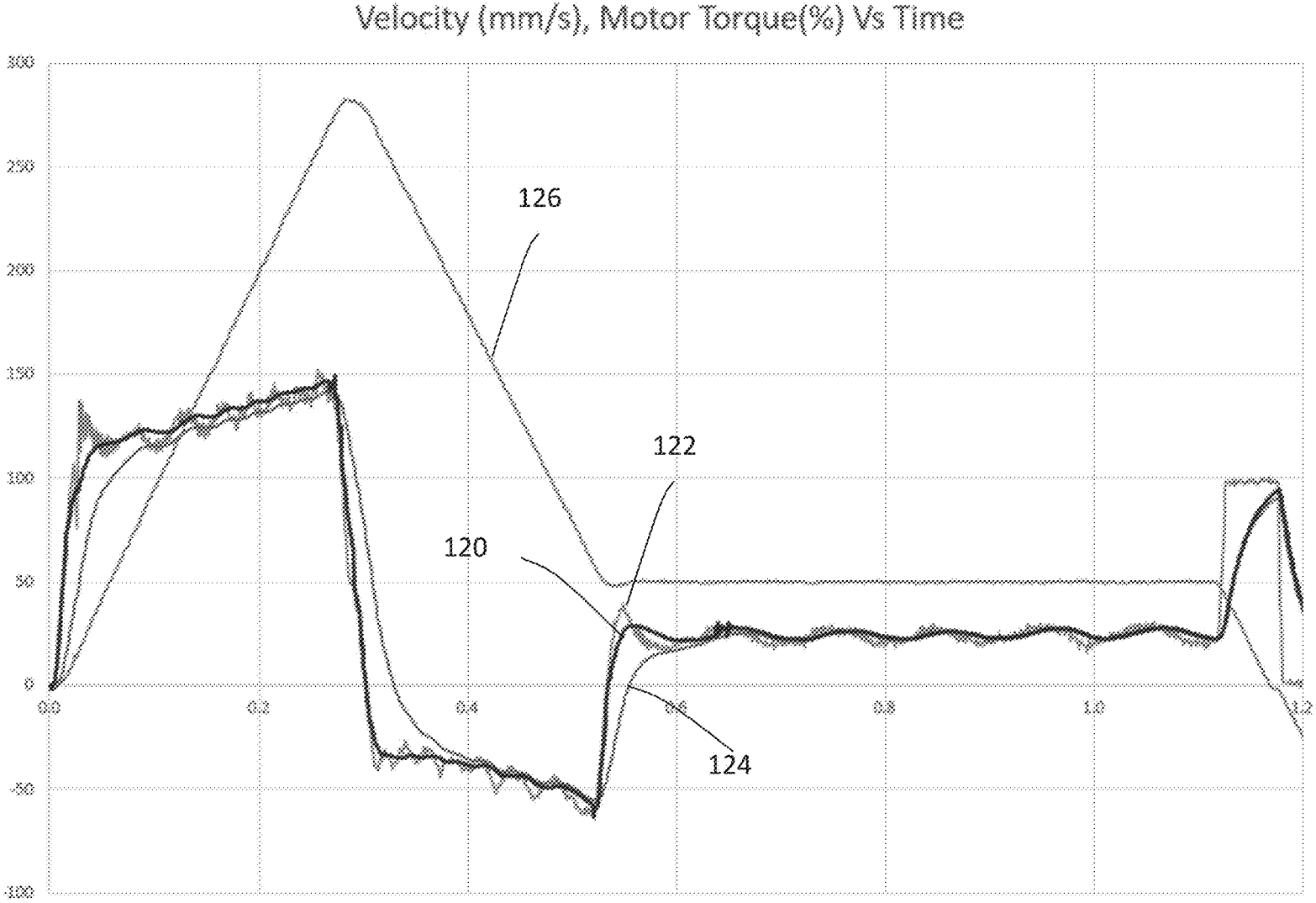
FIG. 12 shows raw and smoothed data from a fastener setting tool.

FIG. 12 shows data from a real tool, operating a FAS-type insertion cycle. In particular, smoothed torque data 120 is shown in comparison to raw data 122 and a simple running average 124. Also shown for reference is the setter velocity 126.

Further enhancement of sampling and/or smoothing may be particularly useful to reduce the effect of periodic changes in parameter values. For example, due to the cyclic nature of a motor, measured torque data typically varies periodically depending on where in the motor revolution cycle the measurement is performed. Sampling from such oscillating data may result in sampling error. This oscillation is particularly prevalent for low setter speeds, for example below 200 mm/s.

Figure 13:
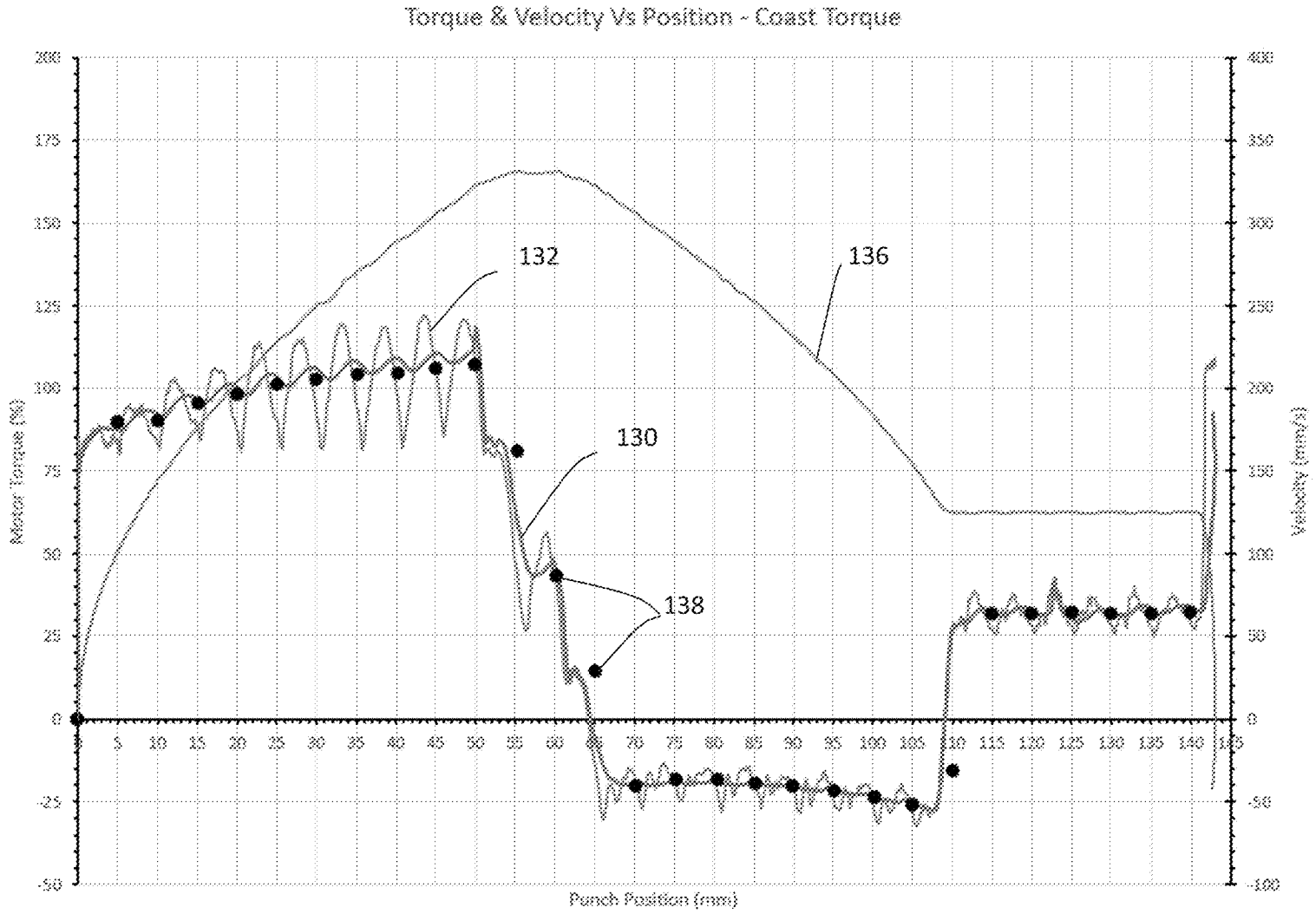
FIG. 13 shows raw and smoothed data from a fastener setting tool.

An oscillation in measured torque data can be seen in FIGS. 12 and 13. FIG. 13 shows data from a real tool, operating a FAS-type insertion cycle, with a different period of motor oscillation and setter speed compared to that shown in FIG. 12. In particular, the period of oscillation and setter speed are such that the measured torque oscillates approximately every 5 mm of setter movement. 5 mm corresponds to the distance travelled for each revolution of the motor and tool given a 5 mm lead on the roller screw and a 1:1 gear ratio between the tool and motor. It can be seen that the oscillation is apparent in both the raw data 132 and the smoothed running average data 130. Also shown for reference is the setter velocity 136.

To calculate a more stable reading, an intelligent smoothed running average process may be used. In particular, the smoothed running average is calculated in dependence on the revolution of the motor. The averaging could be a simple numeric sum of the motor torque measurements occurring within a particular motor revolution, divided by the number of measurements taken within that motor revolution.

In a first example illustrated in FIG. 13, measurements within a particular motor revolution are averaged at the same point during the motor revolution. In this instance, the measurements are averaged every motor revolution, taking into consideration all measurements taken during that motor revolution.

That is, the measurements are averaged for every 5 mm of setter movement (given a 5 mm lead on the roller screw and a 1:1 gear ratio between the tool and motor). The averaged samples 138 are shown in FIG. 13, having been calculated every 5 mm of setter movement. It can be seen that this method of intelligent smoothed running averaging reduces jitter of the averaged measurements compared to both the raw data 132 and the simply smoothed running average data 130.

The number of measurements performed during each revolution may depend on the achievable measurement rate and/or the instantaneous tool velocity. A measurement rate of 15 to 50 measurements per motor revolution may be used. The number of measurements per motor revolution may be denoted as $M_{rev}$.

While the example illustrated in FIG. 13 averages each motor revolution, it should be understood that a similar effect could be achieved by averaging at the same point during a motor revolution on non-sequential revolutions. For example, an average could be taken every other motor revolution.

In an alternative averaging method, a fraction f of the motor revolution is selected, and measurements are summed after the motor has revolved said fraction f of its full revolution. That is, measurements are summed every $f \times M_{rev}$ measurements. The resulting summed value may be referred to as a summed fractional measurement. Each set of $f \times M_{rev}$ measurements may be referred to as a positional interval. Over the course of a full revolution of the motor, a 1/f summed fractional measurements are generated.

After the motor has performed a full revolution (and 1/f summed fractional measurements have been generated), an average measurement is calculated based on the sum of each summed fractional measurement divided by the total number of measurements $M_{rev}$. The average may subsequently be updated, and hence referred to as an updated average, each subsequent fraction f of a revolution the motor revolves. The updated average is based upon the sum of the previous 1/f summed fractional measurements. In this way, the average may be updated multiple times (i.e. 1/f times) during a motor revolution, thereby providing additional data points compared to only averaging once each revolution. Each updated average is offset but incorporates the measurements from a complete motor revolution, thereby removing jitter and/or oscillations. Such additional data points may allow more accurate compensation to be provided. For example, additional data points may be of particular benefit in cycles where the coast torque is only achieved for a short distance.

In a specific example, a fraction f=¼ may be selected. A fraction f=¼ corresponds to a quarter of the motor revolution (e.g. 1.25 mm given a 5 mm lead on the roller screw and a 1:1 gear ratio between the tool and motor). In this instance, measurements would be summed every quarter of a motor revolution i.e. every positional interval ($M_{rev}/4$ measurements). That is, a first set of $M_{rev}/4$ measurements would be summed to generate a first summed fractional measurement. Subsequently, a second set of $M_{rev}/4$ measurements would be summed to generate a second summed fractional measurement. A third and fourth summed fractional measurement would be generated in a corresponding manner following measuring and summation of a third and fourth set of $M_{rev}/4$ measurements. A first average is calculated based on the first, second, third and fourth summed fractional measurements. Subsequently, a fifth set of $M_{rev}/4$ measurements is summed to generate a fifth summed fractional measurement, and a second average (corresponding to an updated average) is calculated based on the second, third, fourth and fifth summed fractional measurements. The second average is offset from the first average by a quarter of a motor revolution, but incorporates measurements from a complete motor revolution.

Additionally or alternatively, if a specific measurement lies within the same positional interval as the previous measurement, then the whole of the specific measurement is assigned to that positional interval. If a measurement crosses a boundary between a first and second positional intervals, then a portion of that measurement is applied to a previous data set associated with the first positional interval and the remainder assigned to a new data set associated with the second positional interval. The amount of the measurement apportioned to each positional interval is based on the distance travelled by the tool since the previous measurement. The previous data set corresponds to measurements in the first positional interval which are to be summed to generate a summed fractional measurement, and the new data set corresponds to measurements in the second positional interval which are to be summed to generate another summed fractional measurement.

Figure 14:
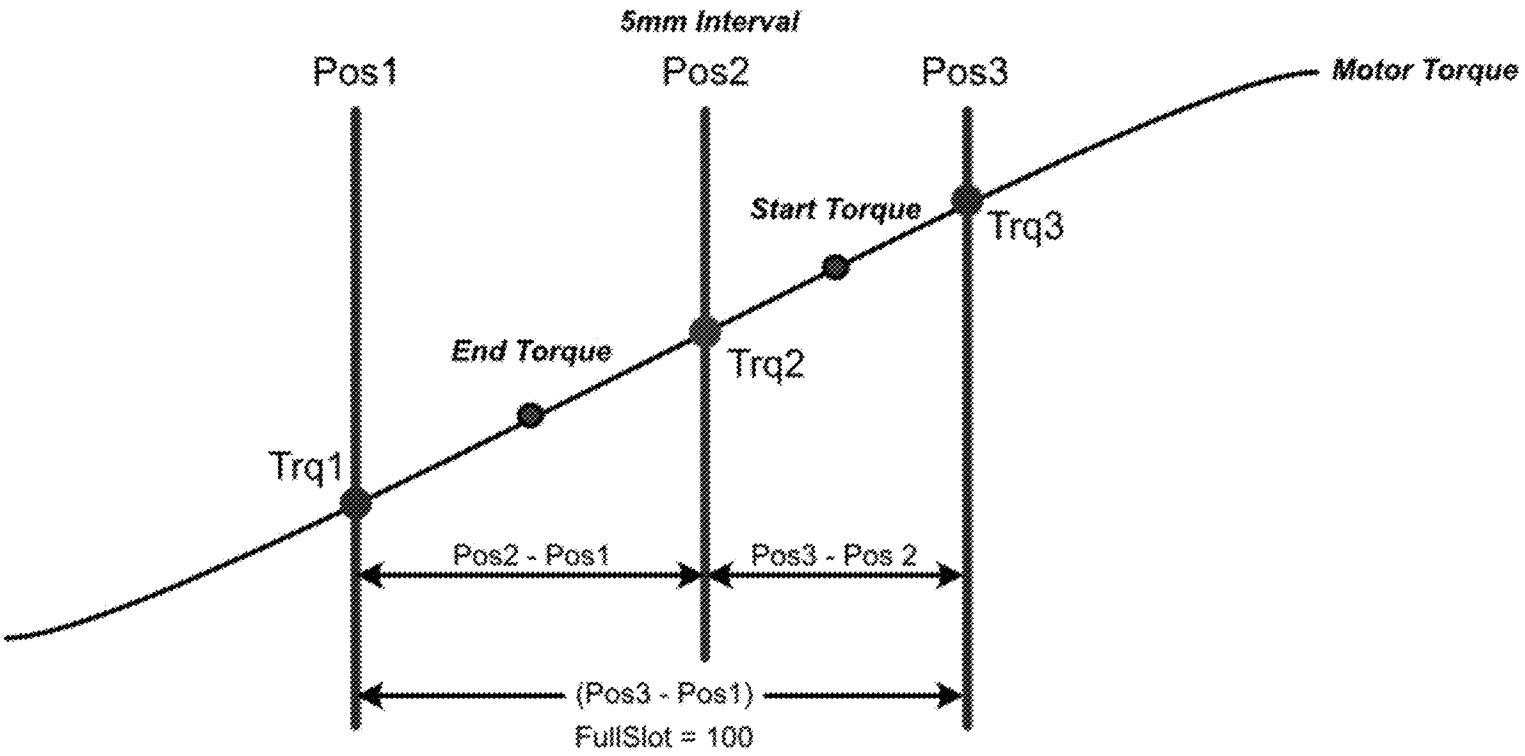
FIG. 14 illustrates an averaging method.

This alternative averaging method is illustrated with reference to FIG. 14, where Trq1 and Trq3 are torque measurements taken at Pos1 and Pos3, each of which correspond to a position of the motor within a motor revolution. Pos3 is a position at a boundary between a first and second positional interval of the motor revolution. That is, as Pos1 and Pos3 are respectively located either side of Pos2, Pos1 and Pos3 each are located in different positional intervals. That is, Trq1 and Trq3 are each measured in different positional intervals.

The method includes estimating a value for the torque Trq2 at a position Pos2 at the boundary between the first and second positional intervals. Assuming, over the short distance travelled, that the torque curve can be approximated to a straight line, then the value of Trq2 at the point Pos2 can be calculated according to equation 12:

$$Trq2 = Trq1 + \frac{(Trq3 - Trq1) \times (Pos2 - Pos1)}{(Pos3 - Pos1)} \tag{12}$$

The portion (End Torque Adder) of the measurements to be added to the previous data set can be calculated according to equation 13. The portion (Start Torque Adder) of the measurements to be added to the new data set can be calculated according to equation 14.

$$\text{End Torque Adder} = \frac{(Trq1 + Trq2)}{2} \times \frac{(Pos2 - Pos1)}{(Pos3 - Pos1)} \tag{13}$$

$$\text{Start Torque Adder} = \frac{(Trq2 + Trq3)}{2} \times \frac{(Pos3 - Pos2)}{(Pos3 - Pos1)} \tag{14}$$

Adding the corrected portion of the measured torque to the relevant data set may minimize errors in the data. This may be particularly applicable as the speed of the tool is increased and/or the number of samples per positional interval is reduced.

A count may be kept, corresponding to the number of measurements (or portions thereof) in a data set. The count may then be used in averaging calculations. The count may comprise the sum of the measurements in a data set, as well as a sum of the percentages of each measurement assigned to a data set. For example, a percentage of 100 corresponds to a complete measurement being added to a data set, and a percentage of less than 100 corresponds to a portion of a measurement being added to a first data set and a portion being added to a second data set. For measurements which occur close to a positional interval boundary, the percentage of a measurement assigned to the previous data set (Sample Count $\text{Adder}_{End}$) can be calculated according to equation 15 and the percentage of a measurement assigned to the new data set (Sample Count Adder start) can be calculated according to equation 16.

$$\text{Sample Count Adder}_{End} = 100 \times \frac{(Pos2 - Pos1)}{(Pos3 - Pos1)} \tag{15}$$

$$\text{Sample Count Adder}_{Start} = 100 \times \frac{(Pos3 - Pos2)}{(Pos3 - Pos1)} \tag{16}$$

These percentages can be added to the count of the previous data set, or used to prime a new count for the new data set.

An average torque over a specific positional interval can therefore be calculated according to equation 17, where measurements correspond to the torque measurements acquired during the positional interval (including portions of measurements taken close to a boundary), and the sample count adders comprises the sum of all percentages maintained, for example calculated according to equations 15 and 16.

$$\text{Average Torque} = \frac{100 \times \sum \text{measurements}}{\sum \text{Sample Count Adders}} \tag{17}$$

Accounting for measurements close to or crossing a positional interval boundary, more accurate data may be achieved, for example by reducing error caused by motor related torque variations. This method may be used alongside other averaging methods, with the weighting of the measurements being adjusted based on the consistency of the sampled data.

While described above with reference to coast torque, intelligent smoothed running average methods may also be used for other parameters, for example acceleration torque. The resultant output of any intelligent smoothed running average method can be used (e.g. entered into a table as described above) in place of single measurements or simple averaging Additionally or alternatively, the resultant output may be used as an additional validation for the previous values, for example while calculating weighted averages for use in the acceleration torque to coast torque look-up table as described above.

While reference has been made above to returning and/or predicting and/or adjusting coast torque or setter velocity, the methods described herein may be used in reference to other characteristics of the tool. For example, it may be beneficial to adjust the clamp limit and/or deceleration torque. While the above examples have described adjustments specifically applied in the advance acceleration and advance at speed phases 200, 202, adjustments may be applied during other phases. For example, an adjustment may be made to the torque limit during the rivet insertion phase 204. This adjustment during the rivet insertion phase 204 may be calculated based on measured parameters measured during any other phase, for example measuring the coast torque during the advance at speed phase 206.

While reference has been made to measuring setter velocity, accelerating torque or coast torque, in other implementations, other parameters may be measured (i.e. relating to other characteristics of the tool). Preferably, the characteristic of the tool comprises a velocity (e.g. of the setter or rivet) and/or motor torque. It should be understood that these characteristics, as well as other characteristics, may be measured using a variety of parameters. For example, velocity of the rivet may be measured directly, or may be inferred indirectly (e.g. by measuring speed and/or acceleration and/or displacement and/or position). For example, motor torque may be measured directly, or may be inferred indirectly (e.g. by measuring motor speed, or electrical stimulation provided to the motor i.e. current, velocity, power etc.). Correspondingly, the same may apply to the predetermined parameter value. It should be noted that, due to the interrelation between various characteristics of a tool, the predetermined parameter value need not relate to the same parameter as the measured parameter, as the skilled person will know how to convert from one to another.

While the term "warmth" has been used to describe the condition of the tool, it should be understood that the condition of the tool is not limited to temperature. The tool may have a condition which ranges from sub-optimal (which may be referred to as cold) to optimal (which may be referred to as warm). A determination of the condition of the tool may be a determination of how close to optimal the tool is performing. The condition may be a representation of an amount of energy loss in the tool, for example due to friction. Generally, a particular tool design will attain an expected torque reading when operating within its normal operating temperature window. If a tool continues to require significant additional compensation irrespective of its operating temperature, a warning may be generated to request a physical inspection of the tool or other maintenance. The physical inspection may be to inspect for component wear and lubrication quality. Such a warning may be provided in response to a determination of the condition of the tool surpassing a condition threshold when the tool is operating with specific characteristics, for example in an allowable temperature band and/or following a minimum operating time and/or number of insertion cycles. Such a warning may be provided in response to a calculated adjustment or compensation surpassing a condition threshold, for example a threshold defining a maximum adjustment that may be applied to a tool. Such a warning may be provided in response to the determination of the condition of the tool surpassing the condition threshold for a specific number of cycles, for example if the condition of the tool remains sub-optimal for a number of cycles.

Where reference is made to a motor of the fastener setting tool, the tool may additionally or alternatively comprise an actuator. The systems and methods herein may be applied to a tool with a motor and/or an actuator. Where reference to a revolution of a motor is made, this may be considered applicable to a revolution of an actuator.

Embodiments of the invention may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic storage media; optical storage media; flash memory devices; electrical, optical, acoustical or other forms of propagated signals (e.g. carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing the firmware, software, routines, instructions, etc. and in doing that may cause actuators or other devices to interact with the physical world.

While specific embodiments of the invention have been described above, it will be appreciated that the invention may be practiced otherwise than as described. The descriptions above are intended to be illustrative, not limiting. Thus it will be apparent to one skilled in the art that modifications may be made to the invention as described without departing from the scope of the claims set out below.

The invention claimed is:

1. A computer implemented method for adjusting a fastener setting tool, the method comprising:

measuring a first parameter associated with a first characteristic of the fastener setting tool, wherein the first characteristic comprises one of a torque of a motor of the fastener setting tool or a velocity of a setting portion of the fastener setting tool;

comparing the first parameter to a predetermined parameter, wherein the difference between the first parameter and the predetermined parameter represents a condition of the fastener setting tool;

calculating an adjustment based on the comparison, wherein the adjustment is to a second characteristic of the fastener setting tool, the second characteristic comprising the other of a torque of a motor of the fastener setting tool or a velocity of a setting portion of the fastener setting tool, the adjustment configured to compensate for the condition of the tool; and applying said adjustment to the fastener setting tool;

wherein the adjustment comprises an instruction to increase the electrical stimulation provided to a motor of the fastener setting tool.

2. The method of claim 1, wherein the condition represents one or more of: temperature, age, use history and lubrication of the fastener setting tool or components thereof.

3. The method of claim 1, wherein the measurement of the first parameter is performed when the second characteristic is at a predetermined second parameter.

4. The method of claim 1, further comprising causing a fastener to be inserted with the adjusted fastener setting tool.

5. The method of claim 1, wherein the measuring is performed during a first fastener insertion cycle and the adjustment is applied in the first fastener insertion cycle.

6. The method of claim 1, wherein the measuring is performed during a first fastener insertion cycle and the adjustment is applied in a second fastener insertion cycle.

7. The method of claim 1, further comprising determining the condition of the fastener setting tool.

8. The method of claim 7, wherein the adjustment is only applied if the condition satisfies a predetermined condition.

9. The method of claim 1, wherein the comparison is further based on one or more stored parameters stored in a storage device of the fastener setting tool, wherein the one or more stored parameters correspond to parameters associated with the fastener setting tool measured prior to the measurement of the first parameter.

10. The method of claim 9, performed iteratively to form a feedback loop.

11. The method of claim 1, wherein a plurality of measurements of the first parameter are taken.

12. The method of claim 11, wherein the plurality of measurements are taken when the first characteristic and/or second characteristic is substantially constant.

13. The method of claim 11, wherein the first parameters associated with the plurality of measurements are averaged.

14. The method of claim 1, wherein the adjustment comprises an instruction to increase the electrical stimulation provided to a motor of the fastener setting tool.

15. The method of claim 1, further comprising providing a warning based upon the condition of the fastener setting tool.

16. A fastener setting tool comprising:

a sensor operable to measure a first parameter associated with a first characteristic of the fastener setting tool, wherein the first characteristic comprises one of a torque of a motor of the fastener setting tool or a velocity of a setting portion of the fastener setting tool;

a data processing system comprising means for carrying out the steps of:

comparing the first parameter to a predetermined parameter, wherein the difference between the first parameter and the predetermined parameter represents a condition of the fastener setting tool;

calculating an adjustment based on the comparison, wherein the adjustment is to a second characteristic of the fastener setting tool, the second characteristic comprising the other of a torque of a motor of the fastener setting tool or a velocity of a setting portion of the fastener setting tool, the adjustment configured to compensate for the condition of the tool; and providing an instruction to the fastener setting tool, wherein the instruction comprises the adjustment; and means to apply said adjustment to the tool;

wherein the adjustment comprises an instruction to increase the electrical stimulation provided to a motor of the fastener setting tool.

* * * * *